US007696424B2

(12) United States Patent
Osuga et al.

(10) Patent No.: US 7,696,424 B2
(45) Date of Patent: Apr. 13, 2010

(54) KEYBOARD APPARATUS OF ELECTRONIC MUSICAL INSTRUMENT

(75) Inventors: Ichiro Osuga, Hamamatsu (JP); Araki Katsuhiro, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 79 days.

(21) Appl. No.: 11/924,524

(22) Filed: Oct. 25, 2007

(65) Prior Publication Data

US 2008/0098874 A1 May 1, 2008

(30) Foreign Application Priority Data

Oct. 26, 2006 (JP) ..... 2006-290835
Oct. 26, 2006 (JP) ..... 2006-290836
Oct. 26, 2006 (JP) ..... 2006-290837

(51) Int. Cl.
*G10C 3/12* (2006.01)

(52) U.S. Cl. ..... 84/423 R

(58) Field of Classification Search ..... 84/423 R, 84/430–436

See application file for complete search history.

(56) References Cited

U.S. PATENT DOCUMENTS

| | | | | |
|---|---|---|---|---|
| 2,622,467 | A | 12/1952 | Kunz | |
| 4,512,234 | A | 4/1985 | Kumano | |
| 6,052,071 | A | 4/2000 | Crowley et al. | |
| 2005/0252364 | A1 | 11/2005 | O'Modhrain et al. | |
| 2006/0165230 | A1 | 7/2006 | Parr | |
| 2008/0017016 | A1 * | 1/2008 | Toyama | 84/439 |

FOREIGN PATENT DOCUMENTS

| | | | |
|---|---|---|---|
| CH | 567469 | | 8/1986 |
| JP | 2003-195853 | | 7/2003 |
| JP | 2008145947 | A * | 6/2008 |

* cited by examiner

*Primary Examiner*—Kimberly R Lockett
(74) *Attorney, Agent, or Firm*—Morrison & Foerster LLP

(57) ABSTRACT

A keyboard apparatus of an electronic musical instrument has a plurality of pivoting members (white key main body 1, black key main body 2, and massive body 28) which pivot in response to depression or release of keys, a frame 3 which supports the pivoting members, and action restricting members (lower limit stopper 5 and upper limit stopper 6) which cause collision thereof with the pivoting members to restrict a range in which the pivoting members are allowed to pivot. The action restricting member contains a plurality of grains 11 in an enclosure member 12, and is arranged, in a state where inflow and outflow of air are allowed between the closed area and outside air, at the frame's side.

19 Claims, 12 Drawing Sheets

KEYBOARD APPARATUS OF ELECTRONIC MUSICAL INSTRUMENT

BACKGROUND OF THE INVENTION

1. Field of the Invention

The present invention relates to a keyboard apparatus of an electronic musical instrument, and more particularly to a stopper member which restricts pivoting of keys of the keyboard apparatus and massive bodies which pivot in synchronization with the keys.

2. Description of the Related Art

In a keyboard apparatus of an electronic musical instruments, conventionally, a range in which keys are allowed to pivot when the keys are depressed (from the initial position to the maximum pivotable position) is restricted by an upper limit stopper and a lower limit stopper provided on a key frame. FIGS. 20A to 20C are right side views schematically illustrating a conventional keyboard apparatus of an electronic musical instrument. The keyboard apparatus has a white key main body 1, a black key main body 2 and a key frame 3. The key frame 3 has front and rear steps in a longitudinal direction of the keys to have a horizontal portion 3*a* between the steps. On the rear end of the horizontal portion 3*a*, a key supporting portion 3*b* is provided.

On the rear end of the white key main body 1, a key pivot portion 1*b* is provided. The white key main body 1 is fastened to the key supporting portion 3*b* with a key pivot portion 1*b* to pivot about the key pivot portion 1*b*. The white key main body 1 has right and left sides formed downward from the both sides of the top surface. The white key main body 1 also has a pair of right and left stopper pieces 1*c* provided at the midpoint near a front end 1*a* of the right and left sides, the stopper pieces hanging downward from the right and left sides. Front ends 1*d* of the stopper pieces 1*c* are bent approximately perpendicularly toward the depth of the key. The black key main body 2 also has a key pivot portion 2*b* and stopper pieces 2*c* on the positions similar to those of the white key. On the front step of the key frame 3, a plurality of parallel slits 3*c* are vertically formed so that the front ends 1*d*, 2*d* of the stopper pieces of the white key and the black key are inserted into the respective slits 3*c*.

On the horizontal portion 3*a* of the key frame 3, a key switch 4 is provided. Projections (actuators) which are not shown are provided on the undersurface of the white key main body 1 and the black key main body 2 to oppose to the key switch 4. On the undersurface of the horizontal portion 3*a* of the key frame, an upper limit stopper 182 which is shaped like a stripe is arranged along the keys so that the upper limit stopper 182 opposes to the top surface of the front ends 1*d* of the stopper pieces 1*c*. On the top surface of the horizontal portion 3*a*, a lower limit stopper 181 is arranged so that the lower limit stopper 181 is shaped like a stripe. In the shown example, the white keys and the black keys have the same structure.

In view of shock absorbency, noise reduction and reproducibility of pivotable range, the upper limit stopper 182 and the lower limit stopper 181 are required to be formed of material having elastic recovery force. Conventionally, felt, polyurethane elastomer or the like is employed as the material of the upper limit stopper and the lower limit stopper. When a player depresses a key, the key switch 4 is elastically compressed to turn on a switch. When the key is further depressed, the lower limit stopper 181 is given a shock by the right and left sides of the white key main body 1 or the black key main body 2 to be elastically deformed. At the time of elastic deformation, internal friction causes kinetic energy to be converted into heat energy, resulting in damping of the key. When the lower limit stopper 181 recovers from elastic deformation, the lower limit stopper 181 produces elastic recovery force. This elastic recovery force becomes repulsion (referred to as rebound) for the key. The rebound is conveyed to the player's finger through the white key main body 1 or the black key main body 2, causing player discomfort.

When the key is released, a force which recovers the key such as action of a recovery spring which is not shown causes the white key main body 1 or the black key main body 2 to return to its initial position. When the key returns, the top surface of the front ends 1*d* of the stopper pieces 1*c* collide with the upper limit stopper 6. At this collision, an elastic recovery force of the upper limit stopper 6 becomes repulsion for the white key main body 1 or the black key main body 2. Since this repulsion is exerted toward the direction opposite to the force which recovers the key, the white key main body 1 or the black key main body 2 vibrates until the key fully stops. If the player's finger touches the key, as a result, the vibration is conveyed to the player to cause discomfort.

In addition, there has been a conventional keyboard apparatus of an electronic musical instrument whose massive bodies pivot in synchronization with player's key-depressions to provide the player with key touch close to that of an acoustic piano. The upper limit of a pivoting massive body is restricted by a collision of the vicinity of a rear free end of an inertial moment generating portion with an upper limit stopper. When a key is released to return to its initial state, the position of the massive body is restricted by a collision of the vicinity of the rear end of the inertial moment generating portion with a lower limit stopper. The upper limit stopper and the lower limit stopper provided for the above-described massive body also absorb shock of inertial moment of the massive body to damp the massive body. The upper limit stopper produces a repulsion when the massive body is driven to collide with the upper limit stopper, while the lower limit stopper produces a repulsion when the massive body recovers to collide with the lower limit stopper.

In an invention disclosed in Japanese Patent Laid-Open No. 2003-195853, for an upper limit stopper provided for hammers (massive bodies), a "massive portion MB" is provided along with the upper limit stopper. In the "massive portion MB", a massive body is sandwiched between a lower cushion and an upper cushion. This massive body is made of elastic material made by blending elastomer or rubber with metal powder so that the material has an appropriate mass and flexibility. In addition, Japanese Patent Laid-Open No. 2003-195853 also discloses that the "massive portion MB" may employ a chain metal wire or a member formed by packing sand or metal powder in a pouched member so that the member has the same width as the entire width of the keys or the width of a plurality of keys. The "massive portion MB" is fastened to a rear part of a chassis by bonding or the like, or is held by enfolding the "massive portion MB" from below upward with a sheet member.

DISCLOSURE OF THE INVENTION

Problems to be Solved by the Invention

In the invention disclosed in Japanese Patent Laid-Open No. 2003-195853, the massive body MB receives an impact from a hammer through the lower cushion. The massive body MB is bonded to be fastened to the chassis through the upper cushion. Therefore, the member formed by packing sand or metal powder in the pouched member does not fully exert its ability. In Japanese Patent Laid-Open No. 2003-195853, in addition, the concrete structure for packing sand or metal powder in the pouched member is not studied. For instance, the structure of the packing member which packs sand or metal powder and the concrete structure applied to a case where conventional stopper members using felt are employed along with the massive portions MB are not studied. In addition, the long-term stability of sand or metal powder packed in the packing member is not studied. Furthermore, cases where the sand or metal powder packed in the packing member travels to unexpected areas due to resting of the musical instrument against a wall or carriage of the musical instrument are not studied.

The present invention was accomplished to solve the above-described problems, and an object thereof is to provide a keyboard apparatus of an electronic musical instrument having an action restricting member which restricts a range in which pivoting members such as keys and massive bodies are allowed to pivot, the action restricting member having a concrete structure which improves key touch to be perceived by a player. In addition, another object of the present invention is to provide a keyboard apparatus of an electronic musical instrument having an action restricting member which restricts a range in which pivoting members such as keys and massive bodies are allowed to pivot, the action restricting member having a concrete structure which enables the action restricting member to retain its ability over the long term in a case where an enclosure member which encloses a plurality of grains is employed as the action restricting member.

Means for Solving Problems and Technical Effect

It is a feature of the present invention to provide a keyboard apparatus of an electronic musical instrument comprising a plurality of pivoting members each of which pivots in response to a depression or release of a key; a frame which supports the pivoting members such that the pivoting members are capable of pivoting; and an action restricting member which causes collision thereof with the pivoting members to restrict a range in which the pivoting members are allowed to pivot, wherein the action restricting member contains a plurality of grains in its closed area partially or entirely enclosed with an enclosure member, and is arranged, in a state where inflow and outflow of air are allowed between the closed area and outside air, at the frame's side along a direction in which the pivoting members are arranged. In this case, the enclosure member has breathability, for instance. Furthermore, the enclosure member is fastened to a breathable base so that the enclosure member and the breathable base form the enclosed area. In the keyboard apparatus configured as above, when a pivoting member collides with the action restricting member, the grains slide and collide with each other, resulting in significant internal losses. Since inflow and outflow of air are allowed between the closed area and outside air, in addition, any repulsion force that would be caused by the internal air pressure of the enclosure member will not be produced when the pivoting member collides with the action restricting member. As a result, any repulsion force will not be exerted on the pivoting member by the action restricting member. Resultantly, the keyboard apparatus of this feature improves key touch to be perceived by a player when he operates the keyboard apparatus.

The enclosure member is a mesh enclosure member, for example. It is preferable that the mesh enclosure member is designed such that dimensions of a mesh opening are smaller than those of the minimum cross-sectional shape of the grains so that the mesh enclosure member can prevent the grains from passing through the mesh openings. The enclosure member may be a thin film having a plurality of air vents, for example. It is preferable that the thin film is designed such that dimensions of an opening of the respective air vents are smaller than those of the minimum cross-sectional shape of the grains so that the thin film can prevent the grains from passing through the air vents. The enclosure member is designed, for example, such that the surface of the enclosure member expands and contracts in accordance with a force externally exerted on the enclosure member. In this case, the action restricting member is able to contain a plurality of grains in its enclosed area without hindering sliding and collisions of the grains enclosed with the enclosure member. In a case where the base is breathable, the thin film employed as the enclosure member may not have the air vents.

In some cases, the enclosed area is entirely enclosed with the enclosure member. In the other cases, the enclosed area is entirely enclosed with the base and the enclosure member. In some cases, furthermore, the base is provided independently of the frame. In the other cases, the base is the frame itself.

In the keyboard apparatus as configured above, points which are located on the action restricting member and with which the pivoting members collide are situated below a position where the action restricting member is fastened to the frame's side. Because the grains gather downward due to gravity, the keyboard apparatus configured as above precisely maintains the points which are located on the enclosure member and with which the pivoting members collide, also precisely restricting the initial position, the maximum pivotable position and the pivotable range of the pivoting members.

In the keyboard apparatus configured as above, the keyboard apparatus further comprises an elastic action restricting member for exerting a repulsion force larger than that of the action regulating member; wherein the action restricting member and the elastic action restricting member are situated at the frame's side such that when the pivoting members pivot, the pivoting members collide with the elastic action restricting member before colliding with the action restricting member. The elastic action restricting member which produces repulsion force has larger recovery force for recovering to its original form. Therefore, it is preferable that the keyboard apparatus is designed such that the pivoting members collide with the elastic action restricting member before colliding with the action restricting member in order to ensure precise positions where the pivoting members collide. As a result, the keyboard apparatus configured as above ensures precise restriction on the initial position, the maximum pivotable position and the pivotable range of the pivoting members. When the pivoting members collide with the action restricting member, the action restricting member absorbs collision energy without producing repulsion force.

In addition, some keyboard apparatuses have massive bodies which pivot in synchronization with depression of keys, however, the other keyboard apparatuses do not have massive bodies. The action restricting member in which the grains are enclosed with the breathable enclosure member may be employed for restriction on the pivotable range of either keys or the massive bodies. Alternatively, the action restricting member may be employed for restriction on the pivotable range of both the keys and the massive bodies. Since the inertial moment of the massive bodies is larger than that of the keys, the action restricting member is more effective in a case where the action restricting member is employed for restriction on the pivotable range of the massive bodies. The action restricting member which does not employ action restricting member in which the grains are enclosed with the breathable enclosure member may employ a conventional elastic action restricting member. The restriction on the pivotable range includes restriction on the upper limit position and that on the lower limit position. The action restricting member in which the grains are contained in its closed area with the breathable enclosure member may be employed for the restriction either on the upper limit position or on the lower limit position. Alternatively, the action restricting member may be employed for the restriction on both positions. In a case where the action restricting member is employed for the restriction on the pivoting caused by key depressions (generally, the restriction on the lower limit position for keys and the restriction on the upper limit position for massive bodies), particularly, the keyboard apparatus configured as above significantly improves key touch to be perceived by a player, for the action restricting member works in a state where the player depresses keys with his fingers.

It is another feature of the present invention to provide a keyboard apparatus of an electronic musical instrument comprising a plurality of pivoting members each of which pivots in response to a depression or release of a key; a frame which supports the pivoting members such that the pivoting members are capable of pivoting; and an action restricting member which causes collision thereof with the pivoting members to restrict a range in which the pivoting members are allowed to pivot; wherein the action restricting member contains a plurality of grains in its closed area partially or entirely enclosed with an enclosure member, and is arranged at the frame's side along a direction in which the pivoting members are arranged; and the closed area enclosed with the enclosure member is provided with a travel restricting member for restricting travel of the grains. In the keyboard apparatus configured as above, when a pivoting member collides with the action restricting member, the grains slide and collide with each other, resulting in significant internal losses. As a result, a repulsion force exerted on the pivoting member by the action restricting member is small. Resultantly, the keyboard apparatus of this feature improves key touch to be perceived by the player when he operates the keyboard apparatus. Because the travel restricting member restricts travel of the grains in the direction in which the pivoting members are arranged, in addition, the keyboard apparatus ensures the ability of the action restricting member over the long term.

In the keyboard apparatus configured as above, the travel restricting member is arranged such that a travel restricting portion is situated at least part of a plurality of locations which are midpoints between points which are located on the enclosure member and with which the pivoting members collide. Because the pivoting members will not interfere with the travel restricting member, as a result, the damping ability of the action restricting member is ensured.

In the keyboard apparatus configured as above, the travel restricting member is provided such that each of a plurality of travel restricting portions is situated at respective locations which are midpoints between points which are located on the enclosure member and with which the pivoting members collide; and the travel restricting member has inclined walls whose lowest ends are points with which the pivoting members collide, and whose highest ends are locations where the travel restricting portions are located. According to this keyboard apparatus, when the pivoting members are no longer in a state of collision, gravity causes the grains to move toward the points with which the pivoting members collide, resulting in the grains recovering to their original state.

In the keyboard apparatus configured as above, the travel restricting member is approximately vertically provided wall members. This keyboard apparatus has the simplest configuration for restricting travel of the grains in the direction in which the pivoting members are arranged. It is preferable that the action restricting member in which the wall members are located within the enclosure member is employed as an upper limit stopper, in particular, for the wall members will not hamper travel of the grains when the grains move upward due to collision of the pivoting members with the enclosure member and when the grains are drawn downward due to gravity. As a result, the keyboard apparatus ensures response of the action restricting member.

In the keyboard apparatus configured as above, the travel restricting member and the enclosure member are partially joined. This keyboard apparatus prevents the travel restricting member from moving within the enclosure member. In addition, the keyboard apparatus also avoid moving of the enclosure member itself and deformation of cross-sectional shape of the closed area.

In the keyboard apparatus configured as above as well, the pivoting members are at least either keys or massive bodies which pivot in synchronization with depression of the keys.

It is still another feature of the present invention to provide a keyboard apparatus of an electronic musical instrument comprising a plurality of pivoting members each of which pivots in response to a depression or release of a key; a frame which supports the pivoting members such that the pivoting members are capable of pivoting; and an action restricting member which causes collision thereof with the pivoting members to restrict a range in which the pivoting members are allowed to pivot, wherein the action restricting member contains a plurality of grains in its closed area partially or entirely enclosed with an enclosure member, and is arranged, in a state where a plurality of sealing portions are formed on the enclosure member along a direction in which the pivoting members are arranged, at the frame's side along the direction in which the pivoting members are arranged. In the keyboard apparatus configured as above, when a pivoting member collides with the action restricting member, the grains slide and collide with each other, resulting in significant internal losses. As a result, a repulsion force exerted on the pivoting member by the action restricting member is small. Resultantly, the keyboard apparatus of this feature improves key touch to be perceived by the player when he operates the keyboard apparatus. Because the closed area of the action restricting member is divided into a plurality of areas by the sealing portions, the keyboard apparatus prevents the grains from traveling in the direction in which the pivoting members are arranged. As a result, the keyboard apparatus ensures the ability of the action restricting member over the long term. Even in a case where the keyboard apparatus leans against a wall or in a case where the keyboard apparatus is held longitudinally for carriage, furthermore, the keyboard apparatus ensures the ability of the action restricting member. In a case where the sealing portions are formed by members for squeezing the enclosure member from outside of the enclosure member, the keyboard apparatus reliably maintains the sealing portions over the long term. In a case where the sealing portions are formed by physical processing of the enclosure member itself, furthermore, the keyboard apparatus reliably maintains the sealing portions over the long term. In the case of the sealing portions formed by physical processing of the enclosure member, in addition, the formation of the sealing portions is easy.

In the keyboard apparatus configured as above, the enclosure member is formed to be shaped like a tube along a direction in which keys are arranged. According to this keyboard apparatus, the formation of the enclosure member is easy, while the handling of the grains is also easy.

In the keyboard apparatus configured as above, the enclosure member is formed by folding a rectangular flat material in two and then joining ends of the rectangular flat material to be shaped like a tube. Therefore, the enclosure member is allowed to be formed by an inexpensive rectangular flat material.

In the keyboard apparatus configured as above, the sealing portions are formed by partially squashing the enclosure member in a direction approximately orthogonal to the direction in which the pivoting members are arranged, and then superposing and joining two layers to approximately form a line; and the action restricting member is arranged at the frame's side such that the pivoting members collide with a plurality of points located on the enclosure member at an angle approximately orthogonal to the sealing portions. According to this keyboard apparatus, because the respective points which are located on the sealing portions and with which the pivoting members collide have the same deformed shape, distortion in shape will not occur. As a result, the keyboard apparatus ensures the abilities of the action restricting member.

In the keyboard apparatus configured as above, the sealing portions are formed by squeezing the enclosure member such that the sealing portions are approximately shaped like a dot. According to this keyboard apparatus, even if the pivoting members collide with the enclosure member at any angle, distortion in shape caused by the sealing portions will not occur. As a result, the keyboard apparatus ensures the ability of the action restricting member.

In the keyboard apparatus configured as above, the sealing portions are provided on at least part of a plurality of locations which are midpoints between points with which the pivoting members collide, the points being located on the enclosure member. Because the pivoting members will not interfere with the sealing portions, the ability of the action restricting member is ensured.

In the keyboard apparatus configured as above as well, the pivoting members are at least either keys or massive bodies which pivot in synchronization with depression of the keys.

DESCRIPTION OF THE PREFERRED EMBODIMENT

Figure 1A:
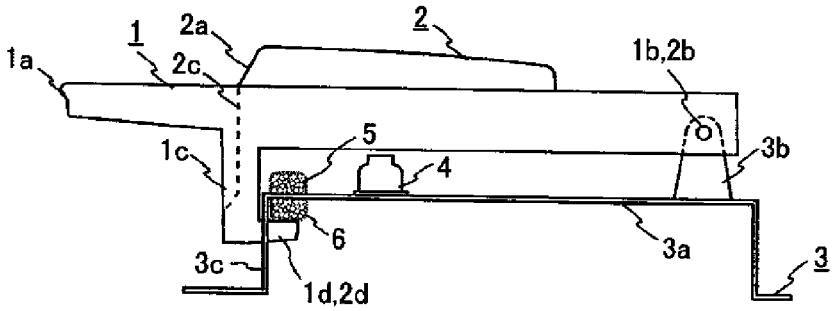
FIGS. 1A to 1C are explanatory drawings illustrating a first embodiment of the present invention.
Figure 1B:
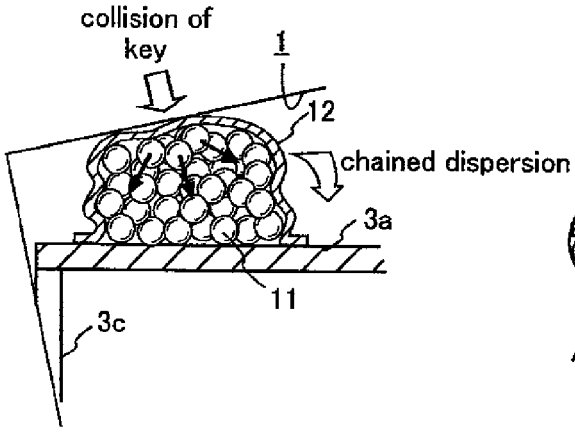
Figure 1C:
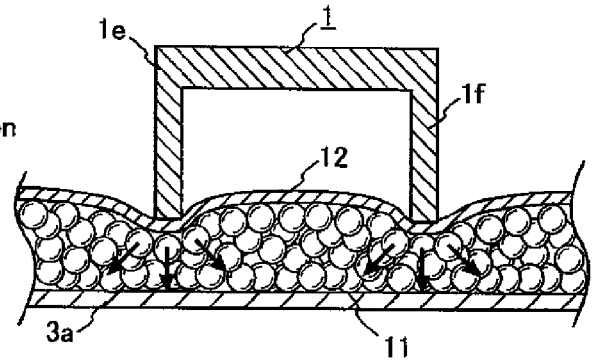
Figure 20A:
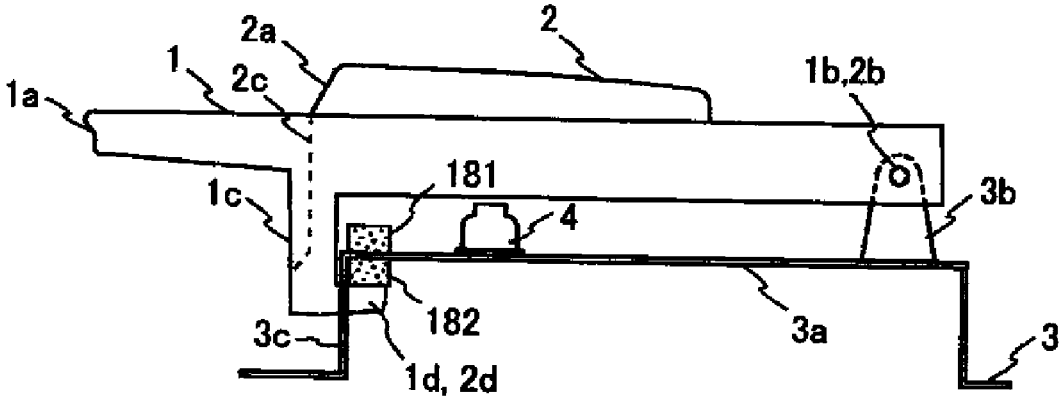
FIGS. 20A to 20C are right side views schematically illustrating a conventional keyboard apparatus of an electronic musical instrument.
Figure 20B:
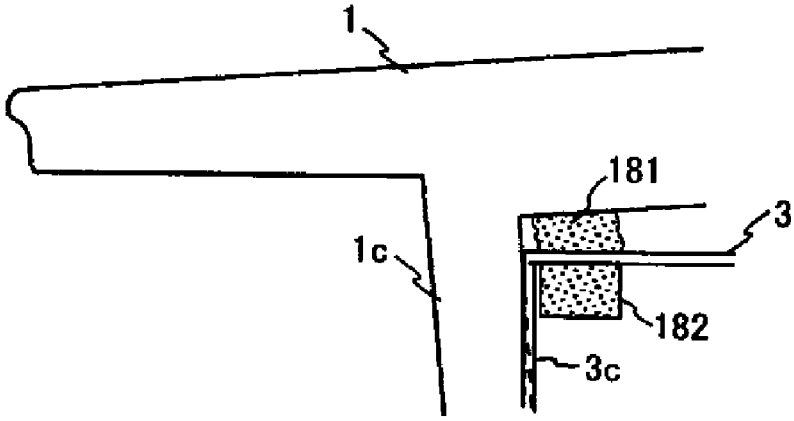
Figure 20C:
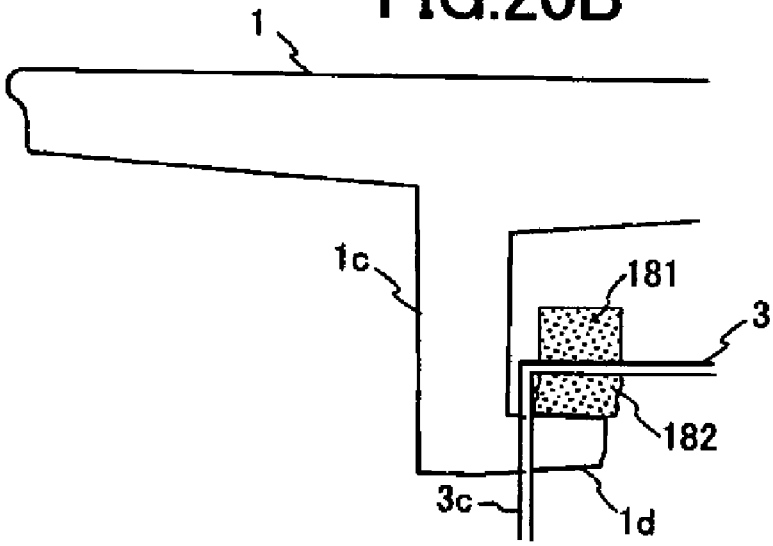

FIGS. 1A to 1C show a keyboard apparatus of an electronic musical instrument according to a first embodiment of the present invention. FIG. 1A is a right side view schematically illustrating the keyboard apparatus. FIG. 1B schematically illustrates behavior of grains provided for a lower limit stopper 5 viewed from the right side. FIG. 1C schematically illustrates behavior of grains provided for the lower limit stopper 5 viewed from the front. In FIGS. 1A to 1C, parts similar to those employed in FIG. 20 are given the same numbers as in FIG. 20 to omit detailed descriptions of the parts. The structure of the lower limit stopper 5 (action restricting member) and an upper limit stopper 6 (action restricting member) of FIG. 1A is different from those used in FIG. 20 described in the related art. The structure of the action restricting members of a black key main body 2 (pivoting member) of FIG. 1A is also different from that used in FIG. 20.

Referring to FIGS. 1B, 1C, a detailed description will be given with the lower limit stopper 5 provided for a white key main body 1 being taken as an example. The lower limit stopper 5 is partially or entirely enclosed with a breathable enclosure member 12 to contain a plurality of grains 11 in a closed area of the lower limit stopper 5. The lower limit stopper 5 is located on a horizontal part 3*a* of a key frame 3

(frame), the horizontal part 3*a* being used as a base of the lower limit stopper 5. The enclosure member 12 is sealed and fixed on the base. The lower limit stopper 5 extends in the direction in which a plurality of keys of the keyboard apparatus are arranged. The lower limit stopper 5 is not necessarily located on the key frame 3 itself, but may be located on anything which fixedly holds the keyboard apparatus as the key frame 3 does. The grains 11, which are solid objects, are shown as spherical objects. In a case where the grains 11 are spherical in shape, it is preferable that the grains 11 measure 3 mm or less in diameter. As described in Japanese Patent Laid-Open Publication No. 2003-19853, the grains 11 can be sand or metal powder. In addition, the grains 11 may also be spherical ceramic, spherical metal, spherical plastic or the like. However, the grains 11 are not necessarily spherical in shape.

The enclosure member 12, which sweepingly restricts behavior of the grains 11 contained therein, is made of a thin flexible material (also referred to as membrane material). The degree of restriction can be freely determined in accordance with the degree of flexibility of the enclosure member 12, however, it is preferable to have such degree of restriction as will not prevent kinetic energy generated by a collision from propagating to the grains 11. More specifically, the enclosure member 12 is something that allows the surface area of the enclosure member 12 to expand and contract in accordance with a force exerted on the enclosure member 12 due to the elasticity imparted to the material of the enclosure member 12. Alternatively, the enclosure member 12 may be something that flexibly deforms or loosens such as cloth. The enclosure member 12 is sealed and bonded or fusion-bonded to the horizontal portion 3*a* which is the base of the lower limit stopper 5, preventing the grains 11 from dispersing.

When the lower ends of a left side portion 1*e* and a right side portion 1*f* of the white key main body 1 collide with the enclosure member 12, kinetic energy generated by the collision is conveyed to the grains 11 through the enclosure member 12. When the grains 11 sequentially collide or slide with each other to move toward arbitral directions, the kinetic energy is converted to heat energy to disappear. Since elastic energy will not be accumulated, as a result, repulsion to a pivoting member will not be produced. Resultantly, the keyboard apparatus is able to eliminate uncomfortable key touch perceived by a player. Because the lower ends of the left side portion 1*e* and the right side portion 1*f* of the white key main body 1 directly collide with the grains 11 through the enclosure member 12, the effect of eliminating the kinetic energy is enhanced, the effect being produced by the moves of the grains 11. Since the breathable enclosure member 12 allows the grains 11 to be contained in a breathable area, in addition, elastic repulsion due to air pressure will not be produced.

In the above description, the lower limit stopper 5 (action restricting member) is described, however, the upper limit stopper 6 (action restricting member) is also located on the underside of the horizontal part 3*a* of the key frame 3, the horizontal part 3*a* being used as the base of the upper limit stopper 6. The enclosure member 12 of the upper limit stopper 6 is also sealed and fixed on the base. However, the relationship between the direction in which the grains 11 receives collision force and the direction in which the grains 11 receives gravity is different from that of the case of the lower limit stopper 5. Therefore, the upper limit stopper 6 basically has the same structure as the lower limit stopper 5, however, the structure can vary between the upper limit stopper 6 and the lower limit stopper 5.

In this specification, the structure in which the grains 11 are enclosed (partially enclosed or entirely enclosed) with the enclosure member 12 will be simply referred to as "particle bag". At least either the lower limit stopper 5 or the upper limit stopper 6 may have the "particle bag" structure with the other stopper being composed of conventional elastic action restricting member (hereafter referred to as elastic action restricting member) made of felt or the like.

Figure 2:
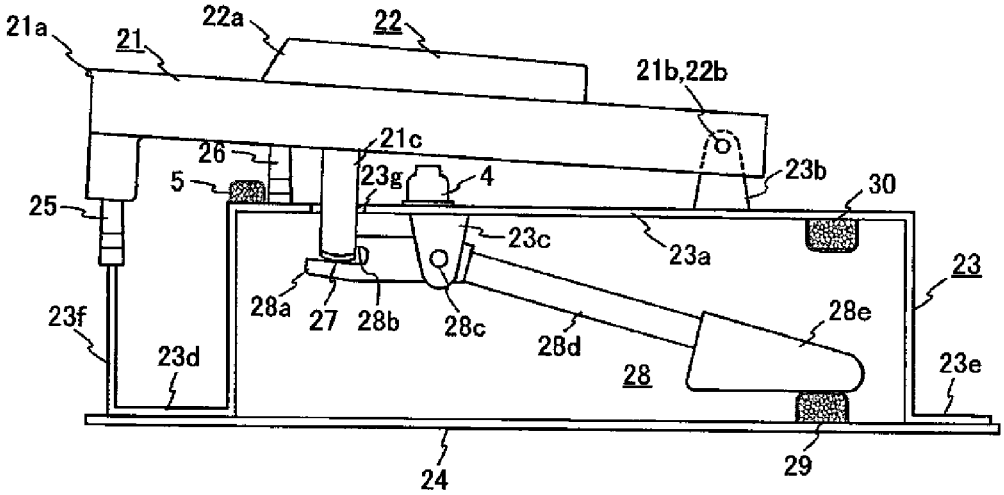
FIG. 2 is a right side view schematically illustrating a second embodiment of the present invention.

FIG. 2 is a right side view schematically illustrating a keyboard apparatus of an electronic musical instrument according to a second embodiment of the present invention. The keyboard apparatus has a white key main body (pivoting member) 21, a black key main body (pivoting member) 22 and a key frame (frame) 23. On the key frame 23, step portions are provided in the forward part and the rear part in the longitudinal direction of the keys. Between the steps, a horizontal portion 23*a* is provided. On the rear part of the horizontal portion 23*a*, a key supporting portion 23*b* is provided. On a forward part of the underside of the horizontal portion 23*a*, a massive body supporting portion 23*c* is provided. On the rear end of the white key main body 21 and the black key main body 22, key pivot portions 21*b*, 22*b* are provided. The white key main body 21 and the black key main body 22 are fastened to the key supporting portion 23*b* at the key pivot portions 21*b*, 22*b*, respectively, so that the white key main body 21 and the black key main body 22 can pivot about the key pivot portions 21*b*, 22*b*, respectively.

In the front and the rear of the step portions of the key frame 23, mounting portions 23*d*, 23*e* are provided in order to mount the key frame 23 to a key frame bottom plate 24. The front of the mounting portion 23*d* is a vertical wall 23*f*. The key frame bottom plate 24 may be a fixing member of the key frame side such as a lower case (shelf board) of the electronic musical instrument. On the vertical wall 23*f*, a key guide 25 is provided for the white key main body 21. The key guide 25 is inserted into the lower portion of proximity of a front end portion 21*a* of the white key main body 21 in order to restrict lateral position and rolling of the key. A key guide 26 fixed to the horizontal portion 23*a* is provided for the black key main body 22. On the horizontal portion 23*a* of the key frame, the key switch 4 which is similar to that shown in FIG. 1 is provided. Projections (actuators) which are not shown are provided on the underside of the white key main body 21 and the black key main body 22 to oppose to the key switch 4.

A force conveying portion 21*c* protrudes from the lower part of the white key main body 21 to penetrate through a hole 23*g* provided on the horizontal portion 23*a* of the key frame. The force conveying portion 21*c* has a bottom plate at its end. On the upper portion of the bottom plate, an aperture which opens to the rear side of the longitudinal direction of the key is provided. On the top surface and the undersurface of the bottom plate, elastic members 27 are fastened (the top surface is invisible). A massive body 28 is provided for each of the white key main bodies 21 and the black key main bodies 22. More specifically, the massive bodies 28 are arranged beneath the respective keys in the direction in which the keys are arranged. The shown massive body 28, which is provided for the white key main body 21, is supported by a massive body supporting portion 23*c* so that the massive body 28 pivots through the force conveying portion 21*c* of the corresponding key.

The massive body 28 has a pivot portion 28*c* supported by the corresponding massive body supporting portion 23*c*, a main driven portion 28*a* and a secondary driven portion 28*b* which are located forward of the pivot portion 28*c* and are engaged with the force conveying portion 21*c* of the key, and an armlike inertial moment generating portion 28*d* which is located in the rear of the pivot portion 28*c* to generate inertial moment. The rear end of the inertial moment generating portion 28*d* is a mass concentrated portion 28*e*.

The main driven portion 28*a* and the secondary driven portion 28*b* are engaged with the force conveying portion 21*c* such that the bottom plate of the force conveying portion 21*c* is sandwiched between the main driven portion 28*a* and the secondary driven portion 28*b* through the elastic member 27. When the massive body 28 pivots in synchronization with a player's depression of the key, a counteraction determined in accordance with inertial moment generated by the inertial moment generating portion 28*d* is imparted from the white key main body 21 to a player's finger. When the player releases his finger from the key, the massive body 28 pivots backward due to the action of gravity to return to the shown position.

A force conveying portion of the black key main body 22, which is not shown, is located at a position where the force conveying portion is overlaid with the force conveying portion 21*c* in the direction of the depth of FIG. 2. For the black key main body 22 as well, therefore, a similar massive body is provided, being supported by a massive body supporting portion to allow pivoting of the massive body. The massive body for the black key main body 22 is turned by the force conveying portion of the corresponding black key.

On the top surface of the horizontal portion 23*a*, the lower limit stopper 5 for the keys is provided to be shaped like a strip as in the case of FIG. 1. An upper limit stopper (action restricting member) 30 for the massive body 28 is provided on the undersurface of the horizontal portion 23*a* of the key frame. The upper stopper 30 restricts the upper limit position of the massive body 28 by use of a collision with the top surface of the mass concentrated portion 28*e* when the massive body 28 pivots in synchronization with depression of the white key main body 21. A lower limit stopper (action restricting member) 29 for the massive body 28 is provided on the key frame bottom plate 24. The lower limit stopper 29 restricts the initial position of the massive body 28 by use of a collision with the undersurface of the mass concentrated portion 28*e* when the massive body 28 pivots in synchronization with release of the white key main body 21.

The upper limit stopper 30 and the lower limit stopper 29 have the structure of "particle bag" as in the case of the upper limit stopper 6 and the lower limit stopper shown in FIG. 1. Since kinetic energy produced by collision of the massive body 28 is large compared to that produced by collision of a key, it is preferable that the upper limit stopper 30 and the lower limit stopper 29 are designed to have a larger "particle bag" so that more energy is eliminated. The structure of the keyboard having massive bodies and the pivot direction are not limited to those shown in FIG. 2. In some keyboards, massive bodies inclined at an initial position are raised in the vertical direction when keys are depressed. Such keyboards may be designed such that the "particle bags" receive collision in the horizontal direction when the massive bodies are raised in the vertical direction. Alternatively, the massive bodies may be placed at the upper limit at the initial position with the massive bodies being placed at the lower limit when the keys are fully depressed.

Figures 3A, 3B, 3C:
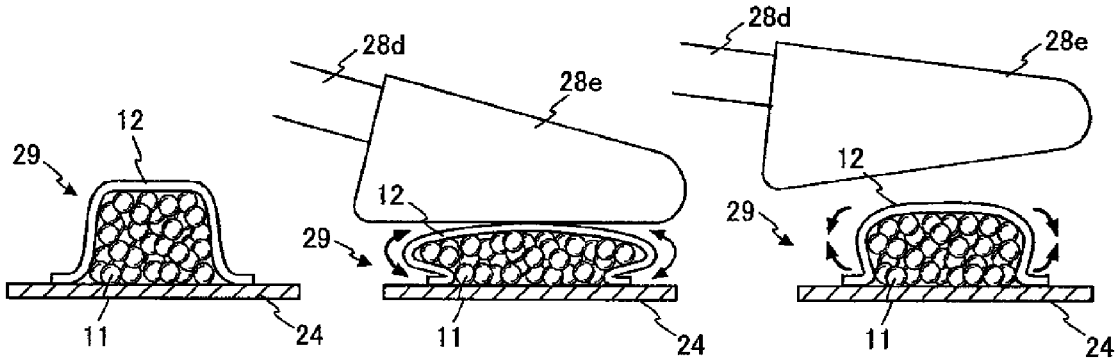
FIGS. 3A to 3C are explanatory drawings illustrating behavior of an enclosure member used in the embodiments shown in FIGS. 1A to 1C and FIG. 2.

FIGS. 3A to 3C illustrate behavior of the enclosure member 12 used in the embodiments shown in FIGS. 1A to 1C and FIG. 2. An example of the lower limit stopper 29 shown in FIG. 2 will be described. The enclosure member 12 has such elasticity as allows the surface to expand and contract in accordance with internally and externally exerted force. FIG. 3A shows an initial state of such enclosure member 12. As shown in FIG. 3B, a collision force produced by a collision of the mass concentrated portion 28*e* with the lower limit stopper 29 causes the enclosure member 12 to expand in the horizontal direction, however, the enclosure member 12 exercises adequate contractive force to confine the grains 11 within a closed area and to entirely restrict behavior of the grains 11. By controlling flexibility of the enclosure member 12, the keyboard apparatus is able to offer player's desired key touch. As shown in FIG. 3C, when the mass concentrated portion 28*e* is released from the lower limit stopper 29, the expanding enclosure member 12 contracts due to its elastic recovery force to return to the initial state shown in FIG. 3A.

Referring to FIGS. 4A to 4F, concrete examples of the enclosure member and an example configuration of the base will be described. FIGS. 4A to 4F illustrate concrete examples of the enclosure member 12 used in the embodiments shown in FIGS. 1A to 1C and FIG. 2. In a concrete example shown in FIG. 4A, a mesh enclosure member 41 is employed as the enclosure member 12. More specifically, the mesh enclosure member 41 can be cloth woven out of thread, knit made of knitted thread, or the like. The mesh enclosure member 41 may be nonwoven cloth made of a plurality of threads crossed each other. The breathability of the mesh enclosure member 41 allows inflow and outflow of air between the area where the grains 42 are confined and outside air. Assuming the enclosure member 12 is not breathable with the closed area containing a considerable amount of air, a collision with the pivoting member (key or massive body) causes expansion of the surface of the enclosure member 12 to exhibit action of air spring. As a result, elastic recovery force is generated, failing to achieve intended effect.

Figure 4A:
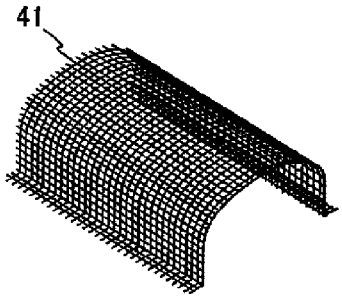
FIGS. 4A to 4F are explanatory drawings illustrating concrete examples of the enclosure member used in the embodiments shown in FIGS. 1A to 1C and FIG. 2.
Figure 4B:
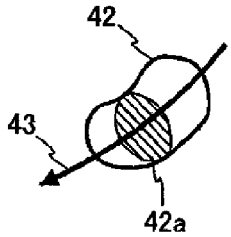
Figure 4C:
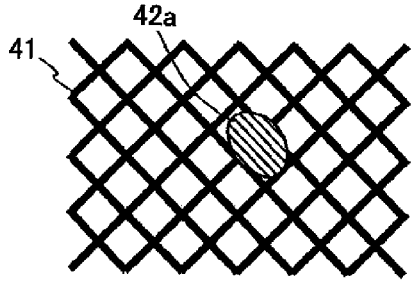

If the mesh enclosure member 41 is rough enough to allow grains 42 to pass through, however, the grains 42 can escape outside. Although the grains 42 can travel in arbitrary directions, therefore, the mesh enclosure member 41 is designed such that the grains 42 are unable to pass through openings of the mesh. In a case where the grains 42 are not spherical, as shown in FIG. 4B, the cross-sectional shape varies according to the position to cut. In this case, a direction toward which a plane having a minimum cross-sectional shape 42*a* is faced is regarded as a passing direction 43. As shown in FIG. 4C, therefore, it is preferable that the mesh enclosure member is designed such that dimensions of a mesh opening are smaller than those of the minimum cross-sectional shape 42*a*, as a guideline, so that the mesh enclosure member 41 is able to prevent the grains 42 from passing through the mesh openings. The mesh enclosure member 41 extends in the direction in which the keys are arranged, however, both ends of the mesh enclosure member 41 situated in the direction of the arranged keys may be covered with the same material as the mesh enclosure member 41 to prevent the grains 42 from flowing away. Alternatively, any different member may be employed to seal the both ends.

Figure 4D:
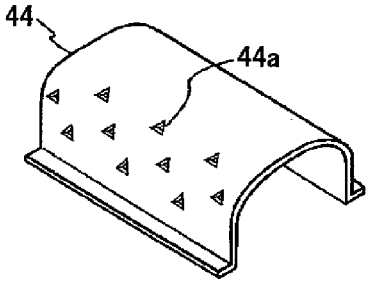
Figure 4E:
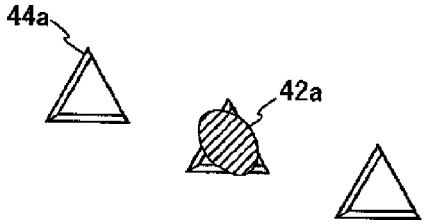

FIG. 4D shows a concrete example in which a thin film 44 is employed as the enclosure member 12. As the thin film 44, plastic, natural rubber, synthetic rubber or the like can be used. Foamed plastic, foamed rubber or the like can be also used as the thin film 44. The thin film 44 is provided with a plurality of air vents 44*a*. The air vents 44*a* may be scattered over the entire surface including the surface at which collisions with the pivoting members (keys or massive bodies) occur. As shown in FIG. 4D, alternatively, the air vents 44*a* may be scattered, avoiding the surface on which collisions occur. As shown in FIG. 4E, it is preferable that the thin film is designed such that dimensions of the air vent 44*a* are smaller than those of the minimum cross-sectional shape 42*a* of each grain, as a guideline, so that the thin film 44 is able to prevent the grains 42 from passing through the air vents 44*a*.

The air vents 44*a* can be any shape, however, it is preferable that the air vents 44*a* have sharp edges such as shown triangle and rectangle. Among the air vents 44*a* having the same cross-sectional area, the air vents 44*a* having sharp edges are more likely to block the grains 42, for many of the grains 42 are round. As a result, the air vents 44*a* having sharp edges are likely to prevent the grains 42 from passing through the thin film 44. In addition, even if the grains 42 are lodged in the air vents 44*a*, clearances on the edges of the air vents 44*a* ensure breathability. The breathability of the thin film 44, in other words, the property of inflow/outflow of air can be controlled in accordance with the size of the air vents 44*a* and the number of the air vents 44*a*.

Figure 4F:
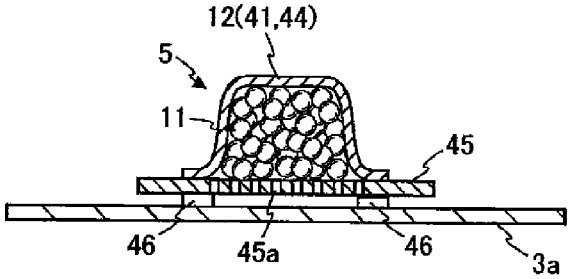

FIG. 4F illustrates an example in which the base of the "particle bag" is provided with a plurality of air vents. In this case, a base portion 45 having air vents 45*a* is provided on the horizontal portion 3*a* of the frame 3 with mount portions 46 being provided between the horizontal portion 3*a* and the base portion 45. As for this structure, the lower limit stopper 5 shown in FIG. 1 will be taken as an example. The mount portions 46 ensure clearances which allow inflow/outflow of air between the base portion 45 and the key frame 3 (the horizontal portion 3*a*). The mount portions 46 may be integrated with the base portion 45 or the horizontal portion 3*a*. Alternatively, the mount portions 46 may be separately configured such as spacer. As the enclosure member 12, the above-described mesh enclosure member 41 or the thin film 44 having the air vents 44*a* may be employed. Alternatively, a thin film without air vents may be employed.

Without using the base portion 45, in FIGS. 1A to 1C, FIG. 2 and FIGS. 3A to 3C, a fixing member of the key frame 3 side (or the key frame 3 itself) may be provided with a plurality of air vents equivalent to the air vents 45*a*. The thin film 44 extends in the direction in which the keys are arranged, however, both ends of the thin film 44 situated in the direction of the arranged keys may be covered with the same material as the thin film 44 to prevent the grains 11 from flowing away. Alternatively, any different member may be employed to seal the both ends.

Figure 5:
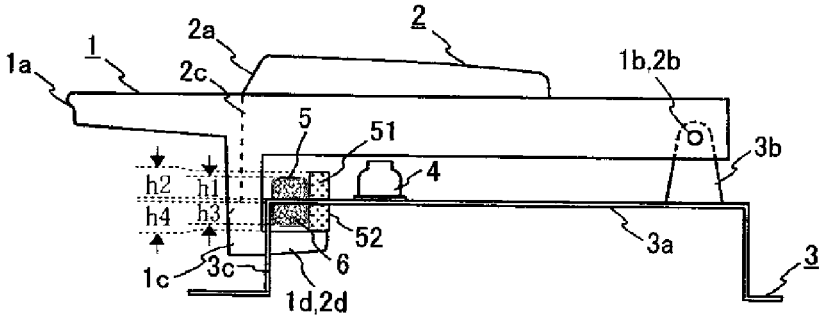
FIG. 5 is an explanatory drawing illustrating a third embodiment of the present invention.

FIG. 5 illustrates a third embodiment of the present invention. The third embodiment is obtained by modifying the first embodiment shown in FIG. 1 such that a conventional elastic action restricting member such as felt is added to the lower limit stopper 5 and the upper limit stopper 6, respectively. In FIG. 5, parts similar to those employed in FIGS. 1A to 1C are given the same numbers as in FIG. 1A to 1C. A felt 51 is provided along with the lower limit stopper 5 which is the "particle bag" to integrally serve as a lower limit stopper. A felt 52 is similarly added to the upper limit stopper 6 which is the "particle bag" to integrally serve as an upper limit stopper.

When the white key main body 1 is depressed, the right and left side surfaces of the white key main body 1 collide with both of the lower limit stopper 5 and the felt 51. Resultantly, advantages of the both can be exploited. More specifically, the "particle bag" offers high damping, but is poor in reproducibility in shape (reproducibility of initial position and operating range of the pivoting member) and in tolerance to repeated depressions. Therefore, the reproducibility in initial position and operating range of a key and the tolerance to repeated depressions are made up for by the conventional elastic action restricting member, so that damping of key and operability of the keyboard apparatus are enhanced. When the white key main body 1 is released to return to its initial position, in addition, the white key main body 1 collides with both of the upper limit stopper 6 and the felt 52. On this collision, advantages of both of the upper limit stopper 6 and the felt 52 can be similarly exploited.

As shown in FIG. 5, assuming the height of the lower limit stopper 5 is h1 with the height of the felt 51 being h2, this embodiment is designed such that it becomes h1<h2. As a result, when the white key main body 1 pivots, the right and left side surfaces of the key collide with the felt 51 first, and then collide with the lower limit stopper 5 provided along with the felt 51. In other words, the felt 51 precedes the lower limit stopper 5 which is the "particle bag", serving as an elastic action restriction.

After the release of the key which follows the collision of the key, the felt 51 immediately restores its original height, for the elastic action restricting member such as felt has higher restoring force than the "particle bag". Resultantly, the felt 51 offers stable action restricting position to subsequent collisions of the key, ensuring accurate action restricting position. The lower limit stopper 5 which is the "particle bag" offers damping ability which does not involve repulsion. Similarly, assuming the height of the upper limit stopper 6 is h3 with the height of the felt 52 being h4, this embodiment is designed such that it becomes h3<h4. When the white key main body 1 returns to the initial position, front ends 1*d* of the stopper pieces collide with the felt 52 to precede the upper limit stopper 6 which is the "particle bag", the felt serving as an elastic action restriction.

The above-described structure of the integrated stoppers ensures accurate pivotable range of the white key main bodies 1 by the interval between the conventional felts 51 and 52. Even if the "particle bag" exhibits imprecise reproducibility of vertical position in some extent, therefore, this embodiment increases accuracy in pivotable range.

Figure 6:
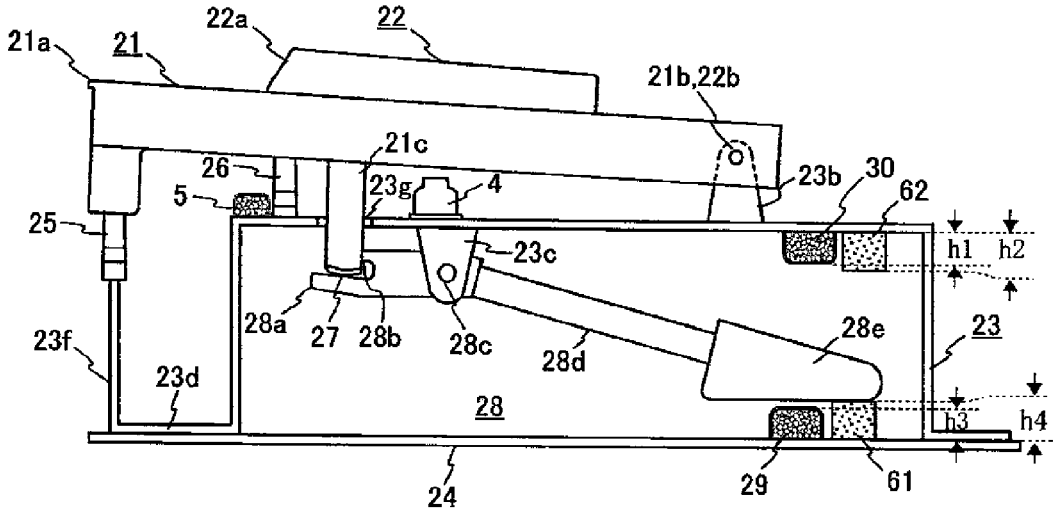
FIG. 6 is an explanatory drawing illustrating a fourth embodiment of the present invention.

FIG. 6 illustrates a fourth embodiment of the present invention. This embodiment is obtained by modifying the second embodiment shown in FIG. 2 such that a conventional elastic action restricting member such as felt is added to the lower limit stopper 29 and the upper limit stopper 30, respectively. In FIG. 6, parts similar to those employed in FIG. 2 are given the same numbers as in FIG. 2. As in the case of the embodiment shown in FIG. 5, a felt 61 is added to the lower limit stopper 29 which is the "particle bag", while a felt 62 is added to the upper limit stopper 30 which is the "particle bag".

Resultantly, a depression of the white key main body 1 results in collision of the top surface of the mass concentrated portion 28*e* with both of the upper limit stopper 30 and the felt 62. As in the case of FIG. 5, therefore, advantages of both of the upper limit stopper 30 and the felt 62 can be exploited. When the white key main body 1 is released, so that the undersurface of the mass concentrated portion 28*e* returns to its initial position, in addition, the mass concentrated portion 28*e* collides with both of the lower limit stopper 29 and the felt 61. On this collision, advantages of both of the lower limit stopper 29 and the felt 61 can be similarly exploited.

As shown in FIG. 6, assuming the height of the upper limit stopper 30 is h1 with the height of the felt 62 being h2, this embodiment is also designed such that it becomes h1<h2. As a result, when the massive body 28 pivots, the felt 62 precedes the upper limit stopper 30 which is the "particle bag", serving as an elastic action restriction for the mass concentrated portion 28*e*. Similarly, assuming the height of the lower limit stopper 29 is h3 with the height of the felt 61 being h4, this embodiment is designed such that it becomes h3<h4. When the mass concentrated portion 28*e* returns to the initial position, the felt 61 precedes the lower limit stopper 29 which is the "particle bag", serving as an elastic action restriction for the mass concentrated portion 28*e*. The above-described structure ensures accurate pivotable range of the mass concentrated portion 28*e* by the control of position of the conventional felts 61, 62. Even if the "particle bag" exhibits imprecise reproducibility of vertical position in some extent, therefore, this embodiment increases accuracy in pivotable range.

In the embodiments shown in FIG. 5 and FIG. 6, the felt which is a conventional stopper member is added to both of the lower limit stopper and the upper limit stopper to increase accuracy in pivotable range. As for the upper limit stopper 6 shown in FIG. 1A and the upper limit stopper 30 shown in FIG. 2, however, the position of the "particle bag" can be easily determined even without the added conventional stopper member because of gravity exerted on the grains.

Figure 7A:
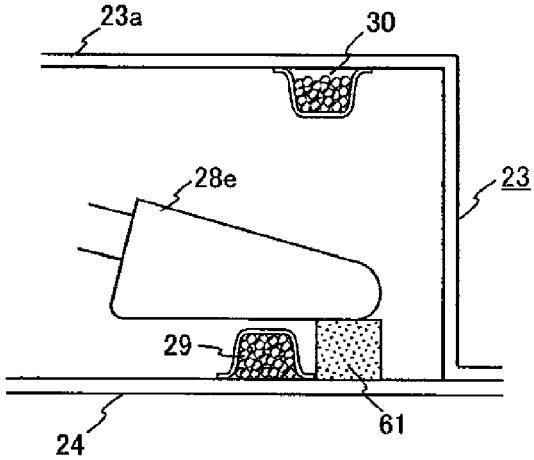
FIGS. 7A, 7B are explanatory drawings illustrating action of gravity exerted on grains provided for an upper limit stopper.
Figure 7B:
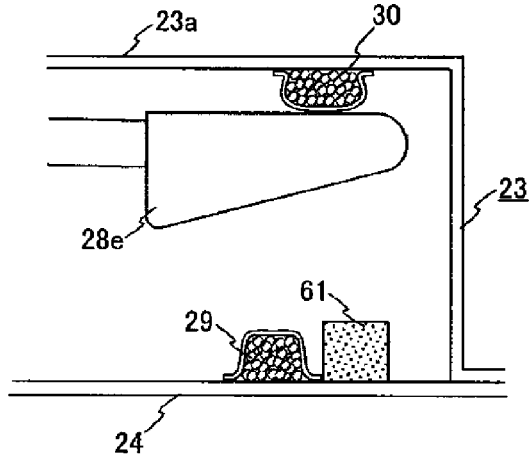

FIGS. 7A, 7B illustrate action of gravity exerted on the grains of the upper limit stopper. FIG. 7A is an enlarged partial view of the keyboard apparatus of a case where the mass concentrated portion 28*e* is placed at the initial position. FIG. 7B is an enlarged partial view of the keyboard apparatus of a case where the mass concentrated portion 28*e* collides with the upper limit stopper 30. In these figures, parts similar to those employed in FIG. 6 are given the same numbers as in FIG. 6. In FIG. 7A, on the upper limit stopper 30 with which the mass concentrated portion 28*e* collides when the massive body 28 pivots, a point where the collision of the mass concentrated portion 28*e* occurs (position of the collision) is situated below the horizontal portion 23*a* of the key frame 23 on which the upper limit stopper 30 is provided.

The plurality of grains 11 contained in the "particle bag" which is the upper limit stopper 30 gather downward due to gravity, determining the position of the undersurface of the enclosure member 12. More specifically, the position of the grains located on an area where a collision occurs is initialized (or reset) by gravity. When the mass concentrated portion 28*e* collides with the upper limit stopper 30 as shown in FIG. 7B, the grains 11 are spread upward. When the mass concentrated portion 28*e* is released from the upper limit stopper 30, however, the grains 11 are restored downward as shown in FIG. 7A. It is preferable that the "particle bag" is designed such that the density of the grains 11 contained in the "particle bag" is low so that the "particle bag" has room at the top of the "particle bag" in order to facilitate upward dispersion of the grains 11.

The "particle bag" described with reference to FIGS. 4A to 4E uniformly extends along the keys. If the grains 11 move to unexpected locations along the keys after a long period of use, therefore, the "particle bag" finally loses damping ability. For instance, when the right and left side portions 1*e*, 1*f* of the white key main body 1 collide with the enclosure member 12 as shown in FIG. 1C, parts located directly beneath the collided right and left side portions 1*e*, 1*f* are dented. When the white key main body 1 then returns upward, the grains 11 are expected to be restored to make the enclosure member 12 flat, however, a long period of use hampers thorough restoration of the enclosure member 12. In addition, if the electronic musical instrument is used in a slightly inclined setting, unintended dispersion of the grains 11 occurs along the direction in which the keys are arranged. Therefore, it is preferable to provide a travel restricting member for restricting travel of the grains 11 along the keys inside the enclosure member 12. As a result, the travel restricting member prevents the grains 11 from traveling in the direction in which the pivoting members are arranged, enabling the action restricting member (lower limit stopper or upper limit stopper) to maintain the damping ability over the long term.

Figure 8A:
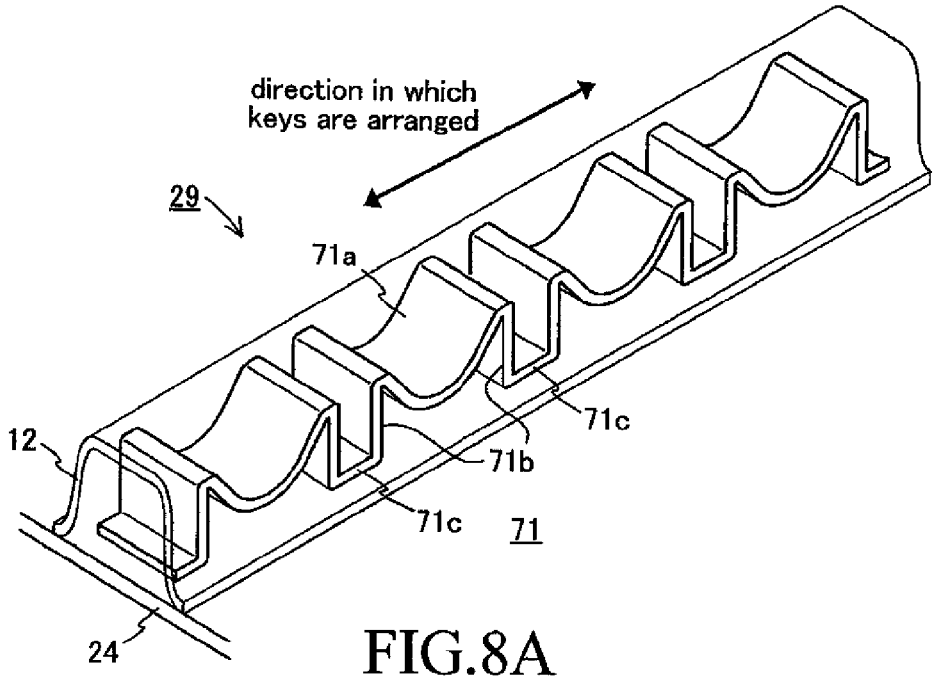
FIGS. 8A to 8C are explanatory drawings illustrating a concrete example of a lower limit stopper shown in FIG. 2, the example showing an action restricting member having a travel restricting member inside.
Figure 8B:
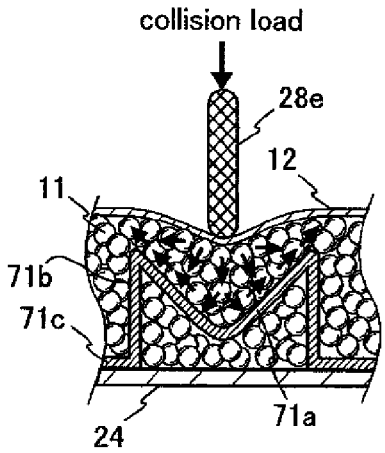
Figure 8C:
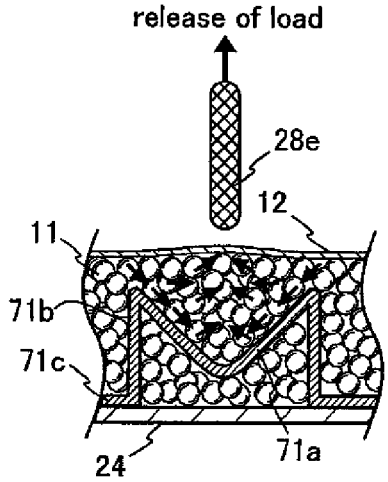

FIGS. 8A to 8C illustrates a concrete example of the lower limit stopper shown in FIG. 2. In this concrete example, a travel restricting member is provided within the action restricting member. FIG. 8A is a perspective view of the lower limit stopper 29. FIGS. 8B, 8C are front views illustrating behavior of a travel restricting member 71. In these figures, parts similar to those employed in FIGS. 1A to 1C and FIG. 2 are given the same numbers as in FIGS. 1A to 1C and FIG. 2. In FIG. 8A, the grains 11 are omitted.

The travel restricting member 71 has inclined walls 71*a*, vertical walls 71*b* bonded to adjoin the inclined walls 71*a*, and bases 71*c* which support the vertical walls 71*b*. The right end of the inclined wall 71*a* is opposed to the left end of the inclined wall 71*a* to form a dent in between. In the travel restricting member 71, the inclined wall 71*a*, the vertical walls 71*b* adjacent to the inclined wall 71*a*, and the bases 71*c* supporting the vertical walls 71*b* are regarded as one unit. The travel restricting member 71 is provided in the closed area entirely enclosed with the key frame 3 and the enclosure member 12, the key frame 3 being the base. The travel restricting member 71 is arranged along the keys, the cross section of each unit of the travel restricting member 71 being approximately shaped like a letter M.

On a vertical line drawn from the lowest end of the inclined wall 71*a*, a point which collides with the mass concentrated portion 28*e* is located. In the shown example, the dent is smoothly curved, however, the right and left sides of the inclined wall 71*a* may be flat, respectively. Respective units are associated with the mass concentrated portions 28*e* of the massive bodies arranged along the keys. The bases 71*c* may be fastened to the key frame 3. Alternatively, the bases 71*c* may be simply placed on the key frame 3.

As shown in FIG. 8B, when the mass concentrated portion 28*e* collides with the lower limit stopper, a collision load is imposed on the grains 11 through the enclosure member 12. The collision load forces the grains 11 to travel, however, the inclined wall 71*a* restricts the directions of the travel of the grains 11. More specifically, when the grains 11 collide with the inclined wall 71*a*, the inclined wall 71*a* generates opposing force to the grains 11. As a result, the grains 11 move upward along the surface of the inclined wall 71*a*. The grains 11 move as if they were fluid. Junctions between the inclined wall 71*a* and the vertical walls 71*b* are the top ends which provide tight space between the enclosure member 12. The top ends serve as obstacles, making it hard for the grains 11 which have moved upward to manage the obstacles to travel to adjacent areas.

As shown in FIG. 8C, when the load is removed, the grains 11 move downward along the surface of the inclined wall 710 to recover to the original flat positions due to gravity and elastic recovery force if the enclosure member 12 exerts any such force. Resultantly, the grains 11 are prevented from traveling beyond a key range in the direction in which the keys are arranged. In other words, the grains 11 are prevented from traveling beyond a range of a massive body. Since the travel restricting member 71 is designed such that the center of the dent of the inclined wall 71*a* coincides with the point where the massive body collides, and that the vertical walls 71*b* joined to the inclined wall 71*a* are situated at the midpoint between collision points of the neighboring massive bodies, traveling of the grains is not hampered by the collision with the massive body.

As described above, the travel restricting member 71 is provided within the space formed of the key frame 3 and the enclosure member 12, the space serving as the "particle bag". More specifically, the inclined wall 71*a* and the joints with the vertical walls 71*b* serve as the travel restricting portion to prevent the grains 11 from traveling in the direction in which the keys are arranged. When the load is removed, in addition, the inclined wall 71*a* forming the dent helps the moved grains 11 recover. Therefore, the travel restricting member 71 enables the "particle bag" to maintain the damping ability for a long period.

Figure 9A:
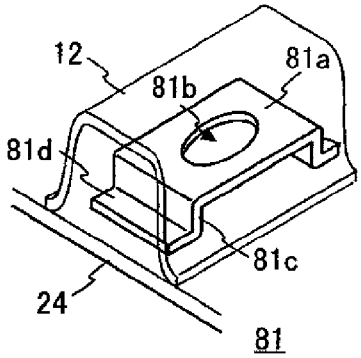
FIGS. 9A, 9B are explanatory drawings illustrating different concrete examples of the lower limit stopper shown in FIG. 2, the examples showing an action restricting member having a travel restricting member inside.
Figure 9B:
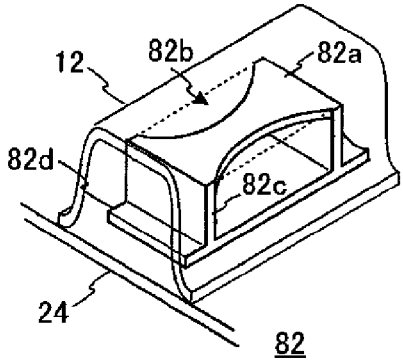

FIGS. 9A, 9B illustrates different concrete examples of the lower limit stopper shown in FIG. 2. In these concrete examples, a travel restricting member is provided within the action restricting member. In both figures, a travel restricting member corresponding to one unit is extracted for illustration. In the concrete example shown in FIG. 9A, a travel restricting member 81 has a horizontal portion 81*a*, an opening 81*b* placed at the center of the horizontal portion 81*a*, vertical walls 81*c* which support the horizontal portion 81*b*, and bases 81*d*. In this example, the vertical walls 81*c* serve as the travel restricting portion to prevent the grains 11 which have entered into an area beneath the opening 81*b* from traveling along the keys.

In the example shown in FIG. 9B, a travel restricting member 82 has a horizontal portion 82*a*, notches 82*b* provided on the front and rear of the horizontal portion 82*a* (in the longitudinal direction of a key), vertical walls 82*c* which support the horizontal portion 82*a*, and bases 82*d*. In this example, the vertical walls 82*c* serve as the travel restricting portion to prevent the grains 11 which have entered into an area beneath the notches 82*b* from traveling along the keys.

Figure 10A:
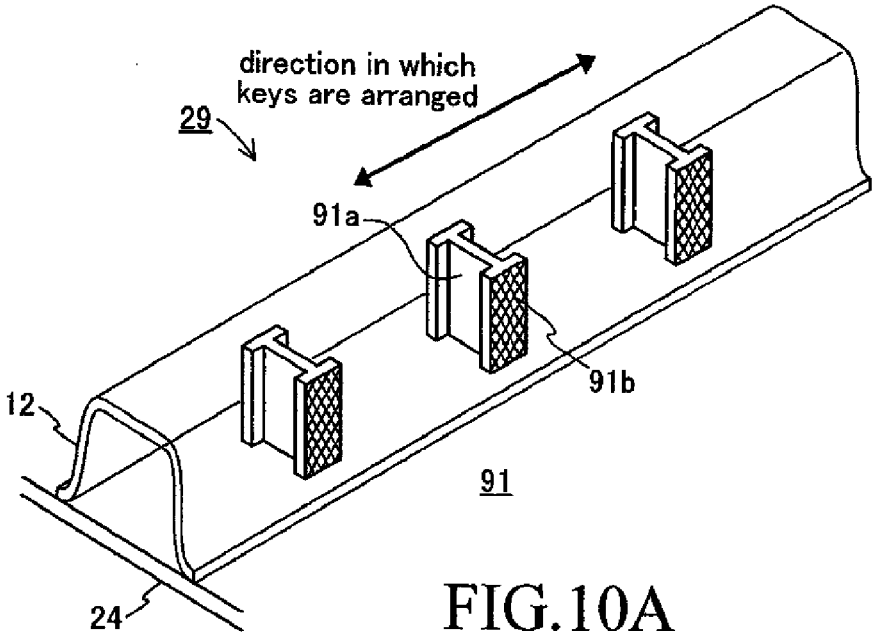
FIGS. 10A, 10B are explanatory drawings illustrating further different concrete examples of the lower limit stopper shown in FIG. 2, the examples showing an action restricting member having a travel restricting member inside.
Figure 10B:
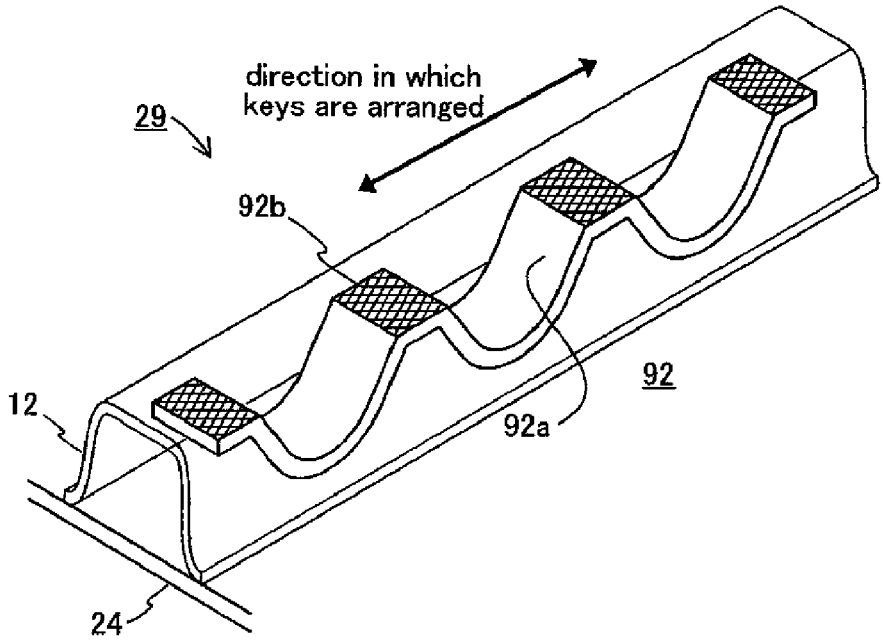

FIGS. 10A, 10B are further different concrete examples of the lower limit stopper shown in FIG. 2. In these concrete examples, a travel restricting member is provided within the action restricting member. In the example shown in FIG. 10A, a travel restricting member 91 has a horizontal cross-section shaped like a letter H. The travel restricting member 91 has vertical walls 91*a* which form a horizontal line of the letter H and flanges 91*b* which are connected to the both sides of the respective vertical walls 91*a* to form longitudinal lines of the letter H. In this example, the vertical walls 91*a* serve as the traveling restricting portions to prevent the grains 11 from traveling along the keys. The vertical wall 91*a* and the flanges 91*b* are regarded as one unit of the traveling restricting member 91. The travel restricting member 91 is provided within an area entirely enclosed with the key frame bottom plate 24 which is the base and the enclosure member 12 in the direction in which the keys are arranged.

The traveling restricting member 91 may be fastened to the key frame bottom plate 24 which is the base or be formed integrally with the key frame bottom plate 24. Alternatively, the travel restricting member 91 may be simply placed on the key frame bottom plate 24. In the shown example, hatched portions of the flanges 91*b* are joined to the enclosure member 12 by bonding, adhering (e.g., double-faced tape), fusion bonding, securing by screws or the like. Even in cases where the travel restricting member 91 is simply placed on the key frame bottom plate 24, therefore, the travel restricting member 91 is secured. Since the enclosure member 12 is fastened to the travel restricting member 91, in addition, the enclosure member 12 is less prone to lose its cross-sectional shape.

Inclined walls 92*a* of a travel restricting member 92 shown in FIG. 10B are similar to the inclined walls 7*a* shown in FIG. 8A. The respective inclined walls 92*a* also have a smooth dent. The travel restricting member 92 has horizontal portions 92*b*. The horizontal portions 92*b* are connected to the top of the inclined walls 92*a* to form the travel restricting portions. The inclined wall 92*a* and halves of the horizontal portions 92*b* located on the both sides of the inclined wall 92*a* are regarded as one unit of the travel restricting member 92. The travel restricting member 92 is provided in the internal area enclosed with the key frame bottom plate 24 which is the base and the enclosure member 12 in the direction in which the keys are arranged. The travel restricting member 92 may be fastened to the key frame bottom plate 24 which is the base. Alternatively, the travel restricting member 92 may be simply placed on the key frame bottom plate 24. Hatched portions of the horizontal portions 92*b* are joined to the enclosure member 12 by bonding, adhering (e.g., double-faced tape), fusion bonding, securing by screws or the like.

In the descriptions referring to FIGS. 8A to 8C, FIGS. 9A, 9B and FIGS. 10A, 10B, the examples are predicated on the lower limit stopper provided for the pivoting of the massive body 28 shown in FIG. 2. However, cases of the lower limit stopper 5 provided for the pivoting of the key shown in FIG. 1A are also similar. However, space between the right and left sides of neighboring keys is slight. Therefore, the right and left sides of neighboring keys such as the left side of a key (corresponding to 1*e* of FIG. 1C) and the right side of a key adjacent to the left of the key (corresponding to 1*f* of FIG. 1C) or the right side of a key (corresponding to 1*f* of FIG. 1C) and the left side of a key adjacent to the right of the key (corresponding to 1*e* of FIG. 1C) may be regarded as one unit of a pivoting member which is equivalent to the above-described mass concentrated portion 28*e*.

Therefore, it is preferable that the travel restricting members 71, 81, 82 are provided such that the travel restricting portions of the travel restricting members 71, 81, 82 are situated at the midpoint of the respective keys (midpoint between the left side 1*e* of a key and the right side 1*f* of a key). Since the travel restricting member 91 shown in FIG. 10A has no direct correlation with collision points, the travel restricting member 91 is not required to provide the travel restricting portion for each midpoint between the neighboring massive bodies 28 (the mass concentrated portions 28*e*) as far as the travel restricting member is located at the midpoint between the neighboring massive bodies 28 (the mass concentrated portions 28*e*). Instead of providing for the midpoint of all the neighboring massive bodies 28, more specifically, the travel restricting portion of the travel restricting member 91 may be provided at desired intervals to have midpoints having no travel restricting portion.

Figure 11A:
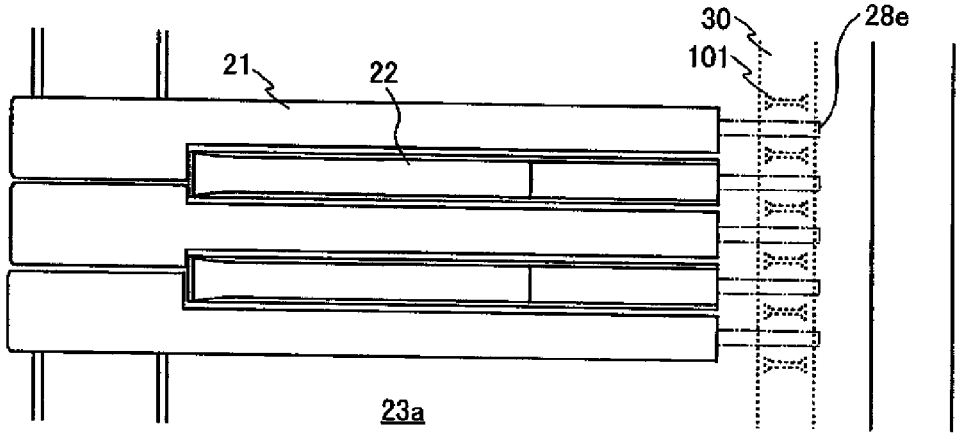
FIGS. 11A to 11D are explanatory drawings illustrating a concrete example of the upper limit stopper shown in FIG. 2, the example showing an action restricting member having a travel restricting member inside.
Figure 11B:
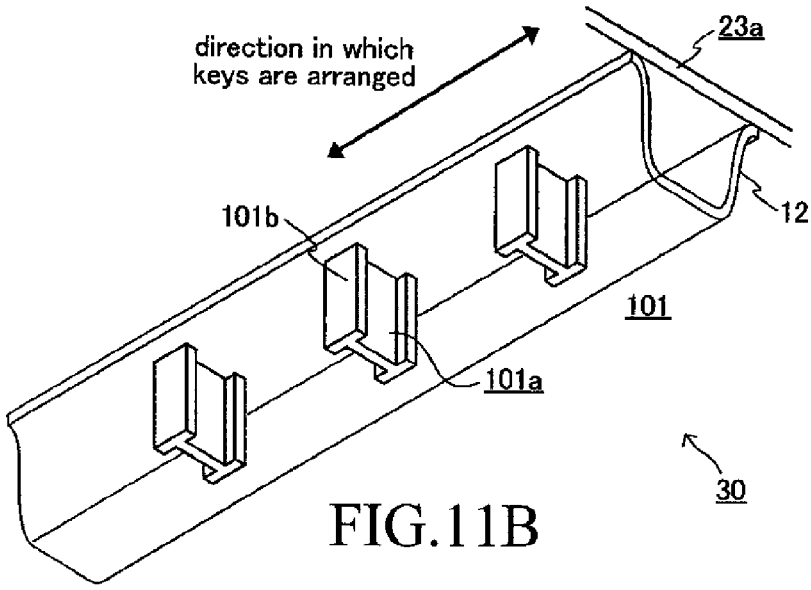
Figure 11C:
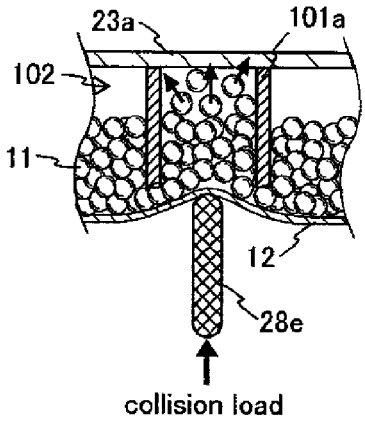
Figure 11D:
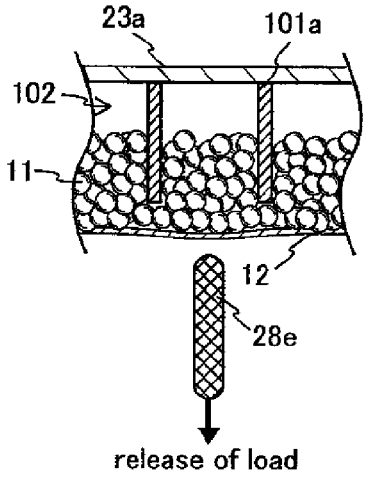

FIGS. 11A to 11D illustrate a concrete example of the upper limit stopper shown in FIG. 2. In these figures, a travel restricting member is provided within the action restricting member. FIG. 11A is a general top view of the keyboard apparatus. FIG. 11B is a perspective view showing the upper limit stopper 30 viewed from below. FIGS. 11C, 11D illustrate operation of the upper limit stopper 30. In these figures, parts similar to those employed in FIGS. 1A to 1C and FIG. 2 are given the same numbers as in FIGS. 1A to 1C and FIG. 2. In FIGS. 11A, 11B, the grains 11 are omitted.

As shown in FIG. 11A, a travel restricting member 101 has a horizontal cross-section shaped like a letter H as in the case of the travel restricting member 91 of the lower limit stopper 29 shown in FIG. 10A. The travel restricting member 101 has vertical walls 101*a* and flanges 101*b*. In this example, the vertical walls 101*a* and gravity prevent the grains 11 from traveling along the keys. The travel restricting member 101 is fastened to the undersurface of the key frame horizontal portion 23*a* which is the base. Alternatively, the travel restricting member 101 is formed integrally with the key frame horizontal portion 23*a*.

In the travel restricting member 101, as shown in FIG. 11A, travel restricting portions are located at points where the mass concentrated portions 28*e* will not collide, that is, at the midpoints between the adjacent mass concentrated portions 28*e*. As shown in FIG. 11D, in the initial state, the grains 11 are pulled down due to gravity. If the grains 11 contained in the closed area are few in number, a clearance 102 is created beneath the key frame horizontal portion 23*a* which serves as a ceiling.

As shown in FIG. 11C, when a load generated by a collision of the mass concentrated portion 28*e* is imposed on the enclosure member 12, the grains 11 are dispersed upward regardless of gravity, bounding in the clearance 102. At the time of dispersion, the vertical walls 101*a* cause the grains 11 to travel mainly in the direction of the collision force (upward in the vertical direction), preventing the grains 11 from squeezing through clearances between the enclosure member 12 and the vertical walls 101*a* to travel in the width direction of the keys. As shown in FIG. 11D, when the load imposed by the mass concentrated portion 28*e* is removed to return to the initial state, the grains 11 are pulled down again due to gravity.

Since the vertical walls 101*a* of the travel restricting member 101 are composed of a vertical surface, as described above, the grains 11 are prevented from traveling along the keys when the grains 11 travel upward as well as when the grains 11 are pulled down by gravity. Because of the vertical walls 101*a*, in addition, friction resistance to the grains 11 is kept at a minimum. As a result, response at the collision of the mass concentrated portion 28*e* and response taken from the removal of a load to the recovery to the initial state are not impaired.

Figure 12A:
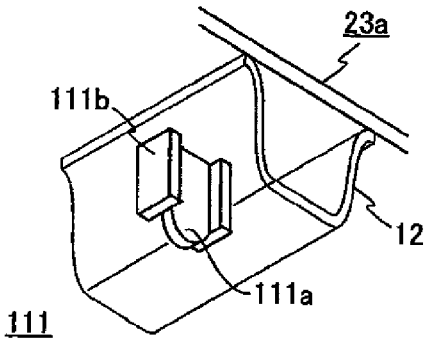
FIGS. 12A to 12D are explanatory drawings illustrating different concrete examples of the upper limit stopper shown in FIG. 2, the examples showing an action restricting member having a travel restricting member inside.

FIG. 12A to FIG. 12D illustrate different concrete examples of the upper limit stopper shown in FIG. 2. In these figures, a travel restricting member is provided within the action restricting member. These figures illustrate one unit of the travel restricting member, respectively. A travel restricting member 111 shown in FIG. 12A is predicated on the travel restricting member 101 shown in FIGS. 11A to 11D, however, the travel restricting member 111 has flanges 111*b* whose height is lower and a vertical wall 111*a* whose end facing the enclosure member 12 is round so that the vertical wall 111*a* coincides with the side section of the enclosure member 12.

Figure 12B:
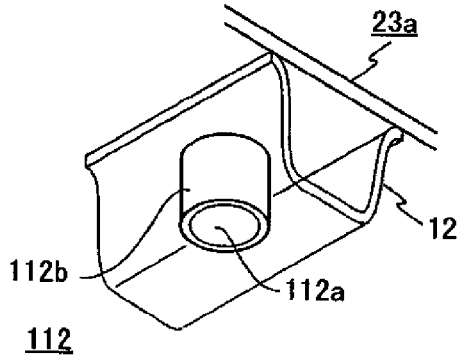
Figure 12C:
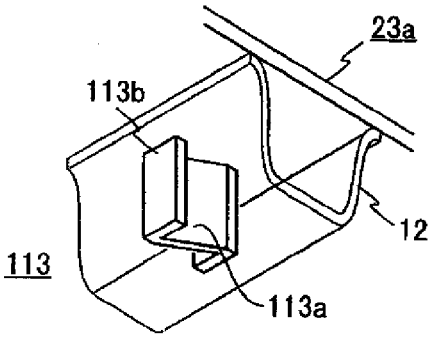
Figure 12D:
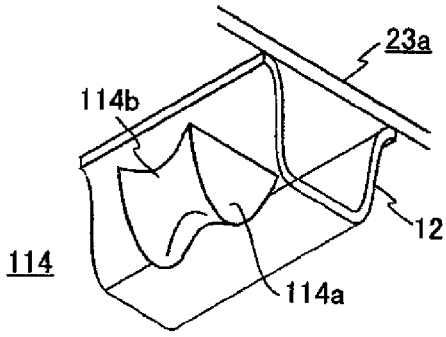

A travel restricting member 112 shown in FIG. 12B employs a cylinder having a circular opening 112*a*. A cylindrical vertical wall 112*b* serves as an approximately vertically provided wall member. A travel restricting member 113 shown in FIG. 12C employs a member having a flipped Z-shaped horizontal cross-section. The travel restricting member 113 has a vertical wall 113*a* inclined toward the direction in which the keys are arranged and flanges 113*b* which support the both sides of the vertical wall 113*a*. A travel restricting member 114 shown in FIG. 12D employs a member shaped like a hollowed saddle having a slightly inclined surface 114*b*. Semicircular side surfaces situated at the front and the rear of the saddle are a pair of vertical walls 114*a*.

The travel restricting members 111 to 114 shown in FIGS. 12A to 12D have a vertical wall, respectively. The vertical wall serves as an approximately vertically provided wall member to prevent the grains 11 from travelling beyond the vertical wall along the keys. The above-described travel restricting members 111 to 114 are fastened to the key frame horizontal portion 23*a* which is the base. Alternatively, the respective travel restricting members 111 to 114 are formed integrally with the key frame horizontal portion 23*a*. The travel restricting members 111 to 114 may be partly connected to the enclosure member 12, which is not shown.

Figure 13:
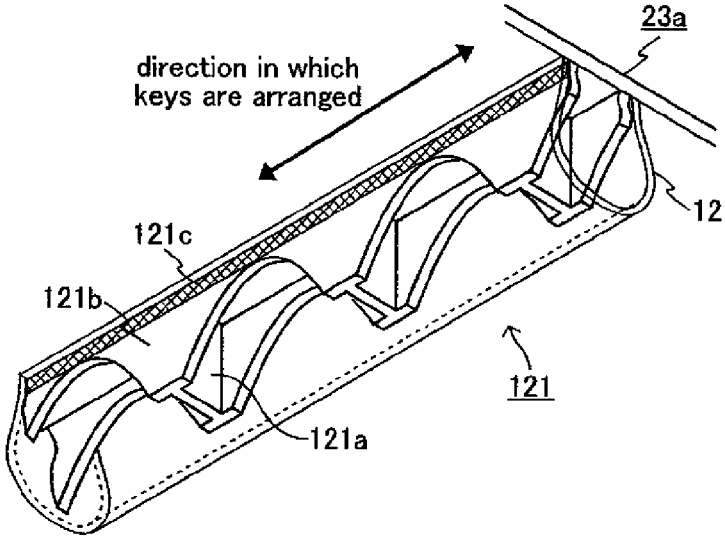
FIG. 13 is an explanatory drawing illustrating a further different concrete example of the upper limit stopper shown in FIG. 2, the example showing an action restricting member having a travel restricting member inside.

FIG. 13 illustrates a further different concrete example of the upper limit stopper shown in FIG. 2. In this figure, a travel restricting member is provided within the action restricting member. FIG. 13 is a perspective view showing the upper limit stopper from below. In this figure, parts similar to those employed in FIGS. 1A to 1C and FIG. 2 are given the same numbers as in FIGS. 1A to 1C and FIG. 2. A travel restricting member 121 is formed by connecting the plurality of travel restricting portions of the travel restricting member 101 shown in FIGS. 11A to 11D to have an integrated member. The travel restricting member 121 has vertical walls 121*a* and arch side plates 121*b*. The vertical walls 121*a* serve as travel restricting portions, while points vertically below the concaves of the arches of the side plates 121*b* are the points where the mass concentrated portions 28*e* collide, respectively.

The above-described travel restricting member 121 is fastened to the key frame horizontal portion 23*a* which is the base. Alternatively, the travel restricting member 121 is formed integrally with the key frame horizontal portion 23*a*. Instead of fastening the sealed enclosure member 12 to the key frame horizontal portion 23*a* which is the base, the sealed enclosure member 12 may be fastened to side surfaces 121*c* of the arch side walls 121*b*, side surfaces 121*c* being located near by the key frame horizontal portion 23*a*.

As far as the travel restricting portion of the above-described travel restricting members is located at the midpoint between the mass concentrated portions 28*e* of the adjacent massive bodies 28, the travel restricting portion may be provided for the midpoint between all the adjacent mass concentrated portions 28. Alternatively, the travel restricting portion may be provided at desired intervals to have midpoints having no travel restricting portion. The above-described travel restricting members are the upper limit stopper 30 provided for the mass concentrated portions 28*e* of the massive bodies 28, however, the above-described travel restricting members may be provided for the upper limit stopper 6 which restricts traveling of keys.

In a case where the keyboard apparatus is left in a state where the keyboard apparatus leans against a wall or in a case where the keyboard apparatus is held longitudinally for carriage, even though the travel restricting member shown in FIGS. 8A to 8C, FIGS. 9A, 9B, FIGS. 10A, 10B, FIGS. 11A to 11D, FIGS. 12A to 12D or FIG. 13 is employed, the grains enclosed with the enclosure member can disperse along the keys. Such dispersion may cause a player to recognize changes in key touch between treble keys and bass keys or may lose desired damping ability.

In concrete examples described below, therefore, the action restricting member is designed to have divided closed areas in order to block traveling of the grains 11 along the keys. In addition, these examples are designed not only to prevent the grains from traveling to unexpected areas during operation but also to maintain the ability of the action restricting member over the long term in spite of long-term use or resting against a wall.

Figure 14:
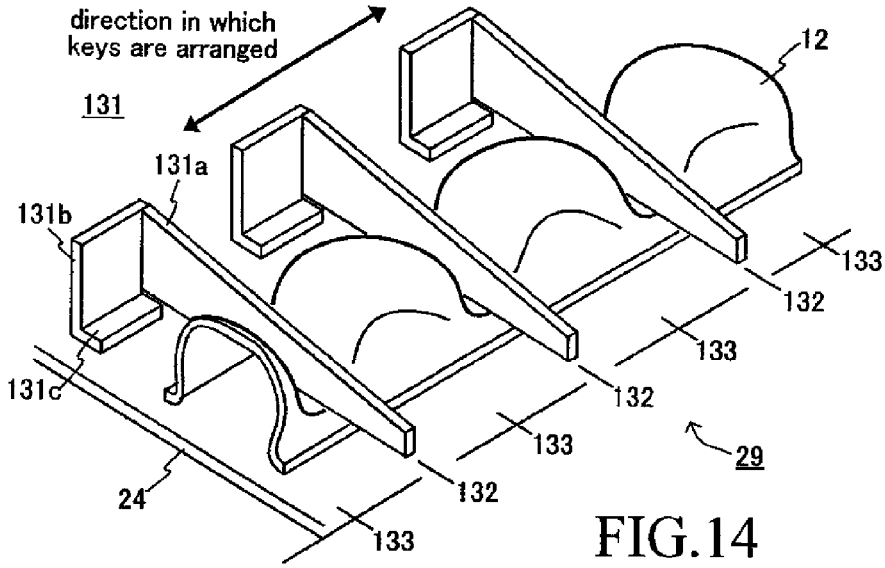
FIG. 14 is an explanatory drawing illustrating a concrete example of the lower limit stopper shown in FIG. 2, the example showing an action restricting member having a travel blocking member outside.

FIG. 14 illustrates a concrete example of the lower limit stopper shown in FIG. 2. In FIG. 14, a travel blocking member is provided outside an action restricting member. In this figure, parts similar to those employed in FIGS. 1A to 1C and FIG. 2 are given the same numbers as in FIGS. 1A to 1C and FIG. 2. In FIG. 14, the grains 11 are not shown. A travel blocking member 131 has arms 131*a*, supporting portions 131*b* which support the arms 131*a* and bases 131*c* which fasten the supporting portions 131*b* to the key frame bottom plate 24. By the travel blocking member 131, joints 132 of the "particle bag" enclosed with the enclosure member 12 and abdomens 133 of the "particle bag" are formed on the key frame bottom plate 24.

The arms 131*a* are located outside the enclosure member 12 to serve as the travel blocking member which squashes the "particle bag" from the outside of the enclosure member 12. The arms 131*a* divide the closed area of the lower limit stopper 29 formed by the "particle bag" into a plurality of chambers. Since the grains 11 are confined in the divided closed areas (chambers), traveling of the grains 11 along the keys is blocked. Because the above-described joints 132 (breaks) do not deliver damping ability, the joints 132 are provided at the midpoints which do not require damping between the adjacent mass concentrated portions 28*e*. The mass concentrated portions 28*e* collide with the top of the abdomens 133 (midpoints between the breaks).

Figure 15A:
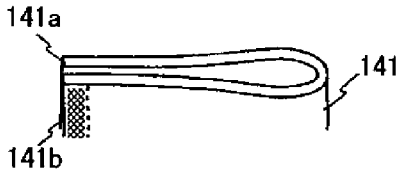
FIGS. 15A, 15B are explanatory drawings illustrating a concrete example of the lower limit stopper shown in FIG. 2, the example showing an action restricting member whose enclosure member has sealing portions.
Figure 15B:
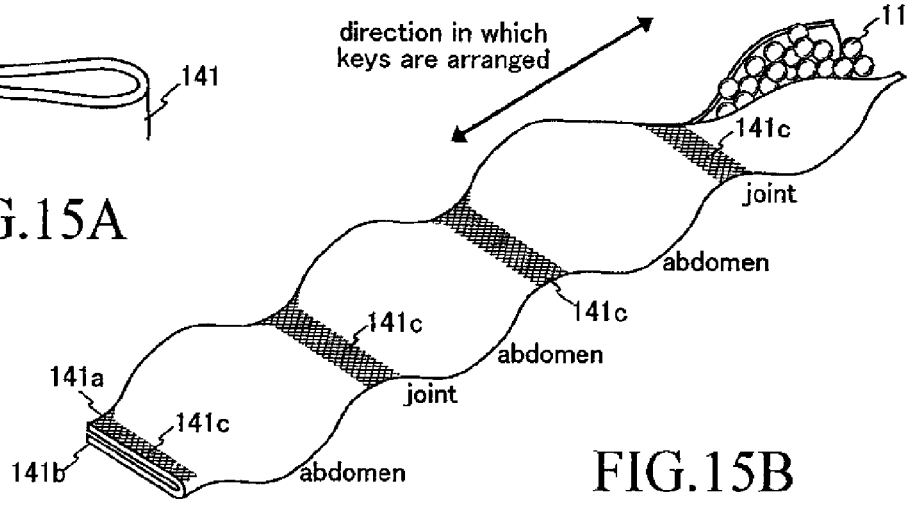

FIGS. 15A, 15B illustrate a concrete example of the lower limit stopper shown in FIG. 2. These figures illustrate an action restricting member whose enclosure member has sealing portions. First, as shown in FIG. 15A, an enclosure member 141 is made to be shaped like a sack. More specifically, a rectangular material formed flat is folded in two to overlay an upper end 141*a* on an opposing lower end 141*b* to bond them together to form a tubular enclosure member 141. The upper end 141*a* and the lower end 141*b* may be bonded together by any commonly used method for bonding opposing surfaces such as fusion bonding of material, bonding with adhesive, sewing together with thread, clipping with clip or the like.

Then, one end of the tubular enclosure member 141 is sealed, while the grains 11 are injected into the enclosure member 141 from the other end. As shown in FIG. 15B, the closed area where the grains 11 are enclosed with the enclosure member 141 is then divided into a plurality of chambers. For the division, the grains 11 located on the breaks are moved to squash the upper and lower layers of the enclosure member to superpose the two layers to approximately form a line. The superposed layers of the enclosure member 141 are then bonded similarly to the bonding of the two ends (the upper end 141*a* and the lower end 141*b*). The bonded approximately linear breaks are flat sealing portions 141*c*. As shown in FIG. 15B, the sealing portions 141*c* are formed in the direction orthogonal to a line drawn along the ends (orthogonal to the direction in which the keys are arranged).

To form the sealing portions 141*c*, it is preferable to draw the enclosure member 141 toward the central axis direction of the arranged keys and gather up the enclosure member 141 before bonding of the sealing portions so that the cross section of the closed area is expanded to allow enclosure of the multiplicity of grains 11. The injection of the grains 11 into the sack-like enclosure member 141 may be done at each creation of the sealing portion 141*c*.

Figure 16A:
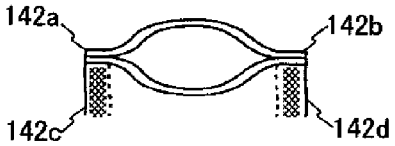
FIGS. 16A to 16C are explanatory drawings illustrating different concrete examples having a tubular enclosure member shown in FIG. 15A, 15B.
Figure 16B:
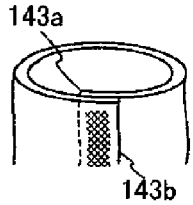
Figure 16C:
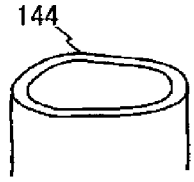

FIGS. 16A to 16C illustrate different concrete examples having the tubular enclosure member shown in FIG. 15. An enclosure member 142 shown in FIG. 16A employs two sheets of flat rectangular material. A left end 142*a* and a right end 142*b* of one sheet are overlaid on a left end 142*c* and a right end 142*d* of the other sheet, respectively, to bond the ends. The ends are bonded in a manner similar to the case shown in FIGS. 15A, 15B. In an enclosure member 143 shown in FIG. 16B, a flat material is rolled to overlay an inner end 143*a* on an outer end 143*b* to bond together. FIG. 16C employs a tubular body 144. Examples of the tubular body 144 include fabric woven to form a sack, circularly knitted work, and tubular injection molded thin-film. In these examples shown in FIGS. 16A to 16C as well, approximately linearly formed sealing portions on the breaks are formed in a manner similar to the case of FIGS. 15A, 15B.

Figure 17A:
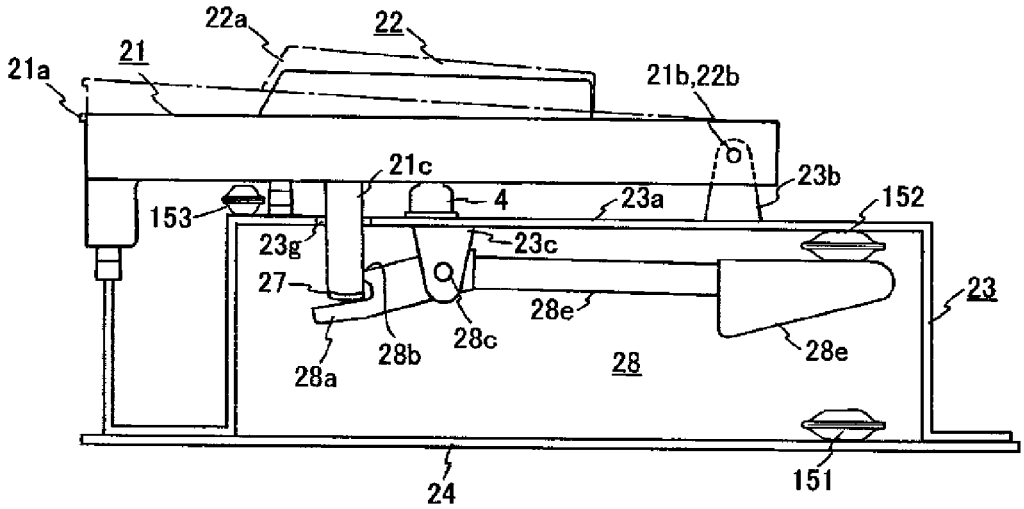
FIGS. 17A to 17E are explanatory drawings illustrating a keyboard apparatus which employs tubular enclosure members having approximately linear sealing portions shown in FIGS. 15A, 15B.

FIGS. 17A to 17E illustrate the keyboard apparatus which employs the tubular enclosure member having the approximately linear sealing portions shown in FIGS. 15A, 15B. Descriptions about the keyboard apparatus shown in FIGS. 17A to 17E will be predicated on the structure shown in FIG. 2. Parts similar to those employed in FIG. 2 are given the same numbers as in FIG. 2. FIG. 17A schematically shows the right side of the keyboard apparatus of the electronic musical instrument. FIGS. 17B to 17E illustrate operations of the upper limit stopper.

A lower limit stopper 151 and an upper limit stopper 152 shown in FIG. 17A restrict action of the massive body 28, respectively. The lower limit stopper 151 and the upper limit stopper 152 are the action restricting members which employs the enclosure member 141 having the approximately linear sealing portions 141*c* described with reference to FIGS. 15A, 15B. A lower limit stopper 153 which restricts action of the white key main body 21 and a lower limit stopper which is not shown and restricts action of the black key main body 22 may employ a similar action restricting member, respectively. These stoppers are located so that they have a horizontal collision surface. The respective action restricting members are secured. Alternatively, the sealing portions 141*c* are supported with members such as the arms 131*c* shown in FIG. 14 so that the corresponding action restricting member retains its original shape.

Figure 17B:
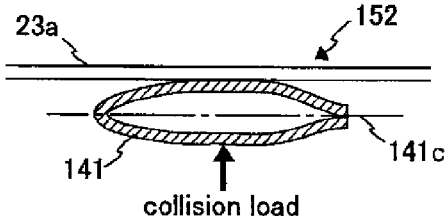

As shown in FIG. 17B, the undersurface of the abdomen of the enclosure member 141 receives a collision load imposed by the mass concentrated portion 28*e*. The action restricting member is provided on the horizontal portion 23*a* of the key frame so that the undersurface of the abdomen becomes approximately parallel with the approximately linear sealing portion 141*c*. Similarly, the lower limit stopper 153 for keys is arranged such that the top surface of the abdomen which receives a collision load becomes approximately parallel with the approximately linear sealing portion 141*c*. Such arrangement allows the mass concentrated portion 28*e* to collide with the enclosure member 141 with an angle approximately orthogonal to the sealing portion 141*c* to impose a collision load, resulting in the collision surface of the enclosure member 141 smoothly becoming nearly flat. Even though the enclosure member 141 has the sealing portion 141*c*, therefore, the enclosure member 141 deforms smoothly between the sealing portion 141*c* which is the joint and the collision portion which is the abdomen, normally delivering damping ability.

Figure 17C:
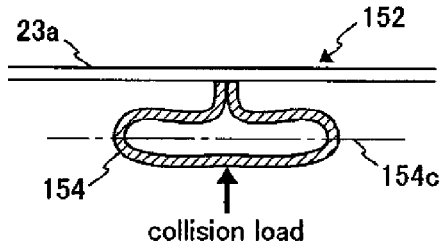

As shown in FIG. 17C, an enclosure member 154 derived from the enclosure member 141 shown in FIG. 15A may be employed. More specifically, the enclosure member 154 is formed by opening the top surface and the undersurface of the enclosure member 141 and then providing the enclosure member 154 which is flat in the direction orthogonal to the superposed ends with linear sealing portions 154*c* which are approximately orthogonal to the line drawn by the ends. In this case as well, the action restricting member is provided on the horizontal portion 23*a* of the key frame such that the undersurface of the abdomen becomes approximately parallel with the approximately linear sealing portion 154*c*. When a collision load is imposed, the collision surface of the enclosure member 154 smoothly becomes nearly flat, resulting in normal damping ability secured for this concrete example.

Figure 17D:
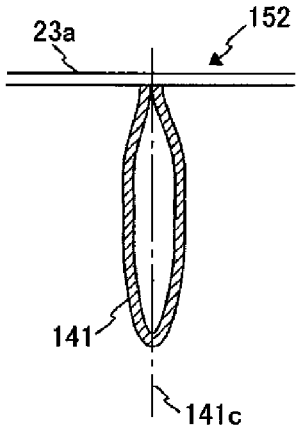
Figure 17E:
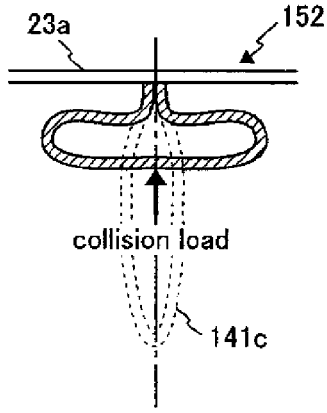

As shown in FIG. 17D, which is provided as a comparison example, suppose the upper limit stopper 152 is provided such that the top surface and the undersurface of the enclosure member 141 and the sealing portion 141*c* are roughly perpendicular to the horizontal portion 23*a*. When a collision load is imposed on the upper limit stopper 152, as shown in FIG. 17E, the enclosure member 141 is squashed down to have a cross-section which is flat in the horizontal direction orthogonal to the approximately linear sealing portion 141*c*. However, the sealing portion 141*c* tries to keep the shape which is approximately linear in the vertical direction, resulting in the sealing portion 141*c* orthogonal to the collision surface. As a result, the collision creates significant distortion on the enclosure member 141 between the collision portion (abdomen) and the sealing portion 141*c* (joint) of the enclosure member 141. Therefore, such arrangement not only hinders smooth damping but also produces ill effect on key touch perceived by the player, decreasing durability of the enclosure member 141.

The above-described behaviors of the upper limit stopper 152 can be similarly applied to the lower limit stoppers 151, 153. In addition, the behaviors of the upper limit stopper 152 can be similarly applied to the cases where the action restricting member having the enclosure member 141 described with reference to FIGS. 15A, 15B is employed for the lower limit stopper 5 and the upper limit stopper 6 for pivoting of keys, the lower limit stopper 5 and the upper limit stopper 6 being used in the keyboard apparatus shown in FIGS. 1A to 1C.

Figure 18:
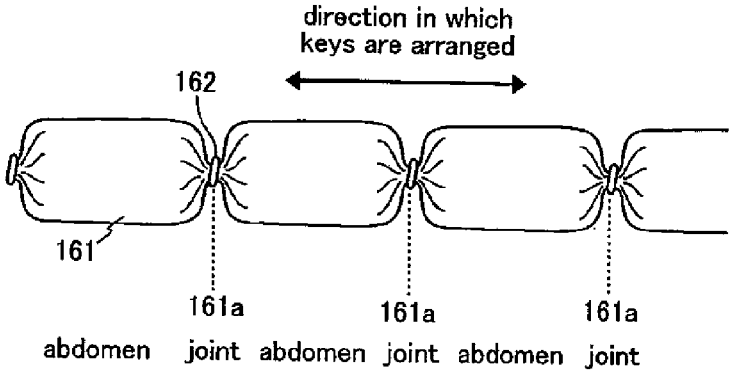
FIG. 18 is an explanatory drawing illustrating a different concrete example which shows formation of sealing portions on a tubular enclosure member shown in FIGS. 15A, 15B.

FIG. 18 illustrates a different concrete example which shows creation of sealing portions on the tubular enclosure member shown in FIGS. 15A to 15D. An enclosure member 161 is squeezed at sealing portions 161*a* with squeezing members 162. No constraint on material is imposed on the enclosure member 161, so that the enclosure member shown in FIGS. 3A to 3C can be employed. In this concrete example, the sealing portions 161*a* are formed by squeezing the enclosure member 161 with the squeezing members 162 so that the sealing portions 161*a* are approximately shaped like a dot.

The squeezing members 162 can be rubber, thread or string. The enclosure member 161 is bound up with thread or string, fastened with rubber or sewed with thread to form the sealing portions 161*a*. Alternatively, metal ring can be employed as the squeezing member 162 to caulk the enclosure member 161 with the metal ring. Without using the squeezing members 162, furthermore, the sealing portions 161*a* can be formed by twisting the enclosure member 161 itself.

Compared to the approximately linear sealing portions 141*c* shown in FIGS. 15A, 15B, assembly of the action restricting member formed by squeezing the enclosure member 161 to have the sealing portions 161*a* approximately shaped like a dot is easy. In addition, the enclosure member 161 has the inner enclosure areas whose cross-section is approximately circular, capable of containing the multiplicity of grains 11. As explained with reference to FIGS. 17A to 17E, furthermore, the approximately linear sealing portions 141*c* have the problem of collision angle at which the massive body or the key collides with the enclosure member 141 (angle anisotropy), however, the sealing portions 161*a* approximately shaped like a dot exert no influence even if the massive body or the key collides with the abdomen of the enclosure member 161 at any angle.

In FIG. 14, FIGS. 15A, 15B, FIGS. 16A to 16C, FIGS. 17A to 17E and FIG. 18, the sealing portions are provided on the enclosure member to divide the enclosure area into the plurality of enclosure areas so that the traveling of the grains along the keys is blocked. The sealing portions are provided at every midpoint between the points where the keys or the massive bodies (pivoting members) which pivot in synchronization with the keys collide. More specifically, as for the massive bodies, every midpoint between the adjacent massive bodies has the sealing portion. As for the keys, the sealing portion is provided at the midpoint of each key.

Figure 19A:
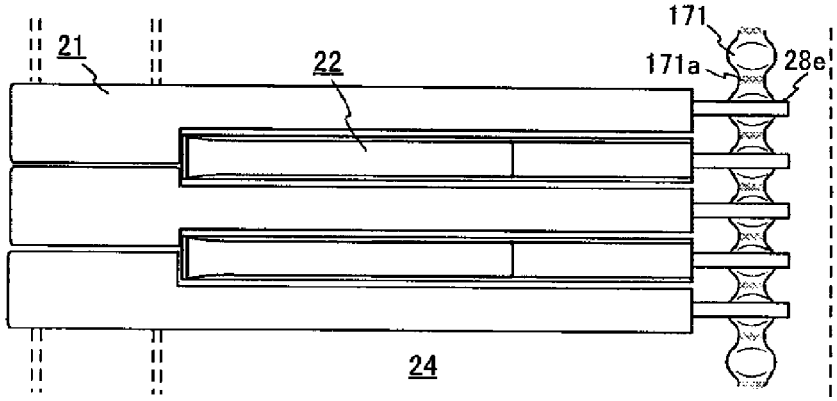
FIGS. 19A, 19B are schematic top views illustrating a concrete example of the lower limit stopper shown in FIG. 2, the top views showing an arrangement of the sealing portions formed on the enclosure member.
Figure 19B:
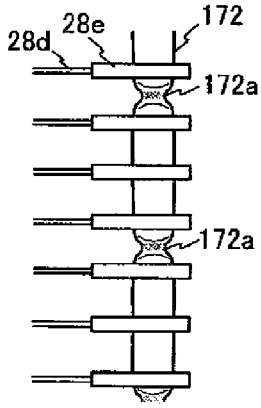

However, the sealing portion may not necessarily be provided at every midpoint. In addition, each enclosure area divided by the sealing portions may contain the travel restricting member shown in FIGS. 8A to 8C, FIGS. 9A, 9B, FIGS. 10A, 10B, FIGS. 11A to 11D, FIGS. 12 to 12D and FIG. 13. FIGS. 19A, 19B, which illustrate concrete examples of the lower limit stopper shown in FIG. 2, are schematic top views showing the arrangement of sealing portions formed on the enclosure member. As the lower limit stopper, FIGS. 19A, 19B are predicated on the action restricting member having the enclosure member shown in FIGS. 15A, 15B. In FIGS. 19A, 19B, parts similar to those employed in FIG. 2 are given the same numbers as in FIG. 2 to omit detailed descriptions.

On an action restricting member 171 shown in FIG. 19A, breaks formed by sealing portions 171*a* are located at each midpoint between the adjacent mass concentrated portions 28*e*. On an action restricting member 172 shown in FIG. 19B, the adjacent three mass concentrated portions 28*e* are regarded as one group to divide the action restricting member 172 by the group. On the action restricting member 172, breaks 172*a* formed by sealing portions are provided at the midpoints between the adjacent groups. More specifically, the mass concentrated portions 28*e* regarded as one group share an enclosed area. As a result, the structure and fabrication of the sealing portions 172*a* can be simplified. In general, each group has the same number of mass concentrated portions 28*e*, however, the number of mass concentrated portions 28*e* may vary from group to group.

In the concrete examples described with reference to FIGS. 15A, 15B, FIGS. 16A to 16C, FIGS. 17A to 17E and FIG. 18, the tubular enclosure members have the sealing portions. In the cases of the action restricting members without sealing portions shown in FIGS. 1A to 1C, FIG. 2, FIGS. 3A to 3C, FIGS. 4A to 4E, FIG. 5, FIG. 6, FIGS. 7A, 7B, FIGS. 8A to 8C, FIGS. 9A, 9B, FIGS. 10A, 10B, FIGS. 11A to 11D, FIGS. 12A to 12D, FIG. 13 and FIG. 14 in which enclosure members are fastened to the base to be sealed, however, a tubular enclosure member may be employed. It is preferable to fill the grains into the enclosure member before fastening the enclosure member to the key frame because the handling of the grains is facilitated to simplify assembly.

In this specification, the upper limit stoppers and the lower limit stoppers (action restricting members) are located on typical positions, however, the upper limit stoppers and the lower limit stoppers may be located any positions other than the shown positions as far as the stoppers are able to perform the action restricting ability for the keys or the massive bodies (pivoting members) which pivot in synchronization with the keys. More specifically, the upper limit stoppers and the lower limit stoppers (action restricting members) are not necessarily required to be provided on the key frame itself however, the stoppers may be provided anywhere as far as the stoppers are provided on the side which fastens the pivoting members. More specifically, the stoppers may be provided on any desired fastening member on the key frame side.

What is claimed is:

1. A keyboard apparatus of an electronic musical instrument comprising:

a plurality of pivoting members each of which pivots in response to a depression or release of a key;

a frame which supports the pivoting members such that the pivoting members are capable of pivoting; and an action restricting member which causes collision thereof with the pivoting members to restrict a range in which the pivoting members are allowed to pivot, wherein the action restricting member contains a plurality of grains in its closed area partially or entirely enclosed with an enclosure member, and is arranged, in a state where inflow and outflow of air are allowed between the closed area and outside air, at the frame's side along a direction in which the pivoting members are arranged.

2. A keyboard apparatus of an electronic musical instrument according to claim 1, wherein the enclosure member is breathable.

3. A keyboard apparatus of an electronic musical instrument according to claim 1, wherein the enclosure member is fastened to a breathable base so that the enclosure member and the breathable base form the enclosed area.

4. A keyboard apparatus of an electronic musical instrument according to claim 1, wherein points which are located on the action restricting member and with which the pivoting members collide are situated below a position where the action restricting member is fastened to the frame's side.

5. A keyboard apparatus of an electronic musical instrument according to claim 1 further comprising an elastic action restricting member for exerting a repulsion force larger than that of the action regulating member; wherein the action restricting member and the elastic action restricting member are situated on the frame or on a fixing member located at the frame's side such that when the pivoting members pivot, the pivoting members collide with the elastic action restricting member before colliding with the action restricting member.

6. A keyboard apparatus of an electronic musical instrument according to claim 1, wherein the pivoting members are at least either keys or massive bodies which pivot in synchronization with depression of the keys.

7. A keyboard apparatus of an electronic musical instrument comprising:

a plurality of pivoting members each of which pivots in response to a depression or release of a key;

a frame which supports the pivoting members such that the pivoting members are capable of pivoting; and an action restricting member which causes collision thereof with the pivoting members to restrict a range in which the pivoting members are allowed to pivot; wherein the action restricting member contains a plurality of grains in its closed area partially or entirely enclosed with an enclosure member, and is arranged at the frame's side along a direction in which the pivoting members are arranged; and the closed area enclosed with the enclosure member is provided with a travel restricting member for restricting travel of the grains.

8. A keyboard apparatus of an electronic musical instrument according to claim 7, wherein the travel restricting member is arranged such that a travel restricting portion is situated at least part of a plurality of locations which are midpoints between points which are located on the enclosure member and with which the pivoting members collide.

9. A keyboard apparatus of an electronic musical instrument according to claim 7, wherein the travel restricting member is provided such that each of a plurality of travel restricting portions is situated at respective locations which are midpoints between points which are located on the enclosure member and with which the pivoting members collide; and the travel restricting member has inclined walls whose lowest ends are points with which the pivoting members collide, and whose highest ends are locations where the travel restricting portions are located.

10. A keyboard apparatus of an electronic musical instrument according to claim 7, wherein the travel restricting member is approximately vertically provided wall members.

11. A keyboard apparatus of an electronic musical instrument according to claim 7, wherein the travel restricting member and the enclosure member are partially joined.

12. A keyboard apparatus of an electronic musical instrument according to claim 7, wherein the pivoting members are at least either keys or massive bodies which pivot in synchronization with depression of the keys.

13. A keyboard apparatus of an electronic musical instrument comprising:

a plurality of pivoting members each of which pivots in response to a depression or release of a key;

a frame which supports the pivoting members such that the pivoting members are capable of pivoting; and an action restricting member which causes collision thereof with the pivoting members to restrict a range in which the pivoting members are allowed to pivot, wherein the action restricting member contains a plurality of grains in its closed area partially or entirely enclosed with an enclosure member, and is arranged, in a state where a plurality of sealing portions are formed on the enclosure member along a direction in which the pivoting members are arranged, at the frame's side along the direction in which the pivoting members are arranged.

14. A keyboard apparatus of an electronic musical instrument according to claim 13, wherein the enclosure member is formed to be shaped like a tube along a direction in which keys are arranged.

15. A keyboard apparatus of an electronic musical instrument according to claim 14, wherein the enclosure member is formed by folding a rectangular flat material in two and then joining ends of the rectangular flat material to be shaped like a tube.

16. A keyboard apparatus of an electronic musical instrument according to claim 14, wherein the sealing portions are formed by partially squashing the enclosure member in a direction approximately orthogonal to the direction in which the pivoting members are arranged, and then superposing and joining two layers to approximately form a line; and the action restricting member is arranged at the frame's side such that the pivoting members collide with a plurality of points located on the enclosure member at an angle approximately orthogonal to the sealing portions.

17. A keyboard apparatus of an electronic musical instrument according to claim 13, wherein the sealing portions are formed by squeezing the enclosure member such that the sealing portions are approximately shaped like a dot.

18. A keyboard apparatus of an electronic musical instrument according to claim 13, wherein the sealing portions are provided on at least part of a plurality of locations which are midpoints between points with which the pivoting members collide, the points being located on the enclosure member.

19. A keyboard apparatus of an electronic musical instrument according to 13, wherein the pivoting members are at least either keys or massive bodies which pivot in synchronization with depression of the keys.

* * * * *